US011495107B2

(12) United States Patent
Gandrud et al.

(10) Patent No.: US 11,495,107 B2
(45) **Date of Patent: *Nov. 8, 2022**

(54) COMPLIANCE METRICS FOR OFFENDER MONITORING DEVICES

(71) Applicant: ATTENTI ELECTRONIC MONITORING LTD., Tel Aviv (IL)

(72) Inventors: Jonathan Dale Gandrud, St. Paul, MN (US); Nicholas Andrew Asendorf, St. Paul, MN (US); Deepti Pachauri, St. Paul, MN (US); Gautam Singh, St. Paul, MN (US); Guruprasad Somasundaram, St. Paul, MN (US); Jennifer Frances Schumacher, St. Paul, MN (US); Nitsan Ben-Gal Nguyen, St. Paul, MN (US); Robert W. Shannon, St. Paul, MN (US); Saber Taghvaeeyan, St. Paul, MN (US); Arash Sangari, St. Paul, MN (US); Himanshu Nayar, St. Paul, MN (US); Mojtaba Kadkhodaie Elyaderani, St. Paul, MN (US); James Bevan Snyder, St. Paul, MN (US); James William Howard, St. Paul, MN (US); David Solomon Segal, St. Paul, MN (US)

(73) Assignee: ATTENTI ELECTRONIC MONITORING LTD, Tel Aviv (IL)

( * ) Notice: Subject to any disclaimer, the term of this patent is extended or adjusted under 35 U.S.C. 154(b) by 0 days.

This patent is subject to a terminal disclaimer.

(21) Appl. No.: 17/391,078

(22) Filed: Aug. 2, 2021

(65) Prior Publication Data

US 2022/0012996 A1 Jan. 13, 2022

Related U.S. Application Data

(63) Continuation of application No. 16/603,256, filed as application No. PCT/IL2018/050378 on Mar. 29, 2018, now Pat. No. 11,087,607.

(Continued)

(51) Int. Cl.
*G08B 21/02* (2006.01)

(52) U.S. Cl.
CPC ..... *G08B 21/0269* (2013.01); *G08B 21/0225* (2013.01); *G08B 21/0227* (2013.01);

(Continued)

(58) Field of Classification Search
CPC ..... G08B 21/0269; G08B 21/0225; G08B 21/0227; G08B 21/0236; G08B 21/0261; G08B 21/0288; G08B 21/22
See application file for complete search history.

(56) References Cited

U.S. PATENT DOCUMENTS 6,100,806 A * 8/2000 Gaukel ..... G08B 21/0211 340/8.1
7,605,696 B2 * 10/2009 Quatro ..... G06Q 10/08 340/572.1

(Continued)

*Primary Examiner* — John A Tweel, Jr.
(74) *Attorney, Agent, or Firm* — Soroker Agmon Nordman; Sharone Godesh; Daniel Schatz

(57) ABSTRACT

Example techniques of this disclosure are directed determining one or more values that represent a monitoring attribute for one or more body-worn tracking devices (BWTDs). In some instances, the techniques include determining a compliance metric that represents a level of compliance for at least one offender. That is, the compliance metric may be a quantitative value that represents whether a user wearing BWTD is complying with established rules or desired behaviors.

14 Claims, 8 Drawing Sheets

Related U.S. Application Data

(60) Provisional application No. 62/483,234, filed on Apr. 7, 2017.

(52) U.S. Cl.
CPC ..... *G08B 21/0236* (2013.01); *G08B 21/0261* (2013.01); *G08B 21/0288* (2013.01)

(56) References Cited

U.S. PATENT DOCUMENTS

| | | | | |
|---|---|---|---|---|
| 8,576,065 | B2 * | 11/2013 | Buck | G08B 21/0283<br>340/435 |
| 9,070,275 | B1 * | 6/2015 | Green | G08B 21/14 |
| 11,087,607 | B2 * | 8/2021 | Gandrud | G08B 21/0261 |
| 2020/0007741 | A1 * | 1/2020 | Johnson | H04N 5/23206 |

* cited by examiner

600

| Parolee | Compliance Score (Yesterday) |
| --- | --- |
| Tazzat Pizzaz | 1.0 |
| Ansp Foetbarl | 0.95 |
| Taz Lodder | 0.95 |
| Bamp D'Ontanne | 0.95 |
| Parsley MacGroveland | 0.9 |
| Somnulous S. Sournz | 0.3 |
| Barth Grokley | 0.2 |

FIG. 6

COMPLIANCE METRICS FOR OFFENDER MONITORING DEVICES

RELATED APPLICATIONS

This application claims priority as a continuation from application Ser. No. 16/603,256 dated Oct. 7, 2019, the disclosure of which is incorporated herein by reference.

TECHNICAL FIELD

This disclosure relates to information systems for tracking geospatial location information related to monitored persons or objects.

BACKGROUND

Released criminal offenders on community supervision, either probation or parole, may be monitored with body-worn tracking devices (BWTDs) by a criminal justice supervising agency, such as a department of corrections or local law enforcement. The monitoring is based on a sentence, and often includes restricted regions and permissible regions with a schedule for the day of the week and a range of times associated with those areas when the released criminal offender is required to be or required not to be in those areas. A released criminal offender's geospatial location at a given date and time is monitored and recorded by tracking devices worn or carried by the released criminal offender. This geospatial information, including date and time information, can be used to determine a released criminal offender's compliance with their sentence. Activities of released criminal offenders can be reported to the criminal justice supervising agency or to a probation or parole officer by fax, page, text message or email generated by a monitoring center unique to the criminal justice supervising agency.

SUMMARY

Techniques of this disclosure are directed determining one or more values that represent a monitoring attribute for one or more body-worn tracking devices (BWTDs). In some instances, the techniques include determining a compliance metric that represents a level of compliance for at least one offender. That is, the compliance metric may be a quantitative value that represents whether a user wearing BWTD is complying with established rules or desired behaviors. In some instances, a computing system may generate one or more notifications or alerts based on the determined compliance metric. In other instances, the computing system may additionally or alternatively adjust one or more monitoring parameters based on the compliance metric. In still other instances, the computing device may generate a graphical representation of the compliance metric, which may assist a monitoring party in assessing a level of compliance for an offender. In this way, the techniques may provide an enhanced measurement of compliance, which may provide a monitoring party a greater understanding of the behavior of an offender (e.g., contextual data that is specific to a particular offender).

In an example, a system comprises at least one body-worn tracking device (BWTD) configured to transmit location data that indicates a location of the at least one BWTD; and a computing system configured to communicate with the at least one BWTD, and wherein the computing system is further configured to: receive the location data from the at least one BWTD; determine, for a time period comprising a plurality of instances of the location data, a compliance metric based on a set of compliance parameters, the compliance metric indicating a level of compliance for at least one offender for the time period; and perform at least one operation based on the compliance metric.

In another example, a method comprises receiving location data from at least one body-worn tracking device (BWTD), wherein the location data indicates a location of the at least one BWTD; determining, for a time period comprising a plurality of instances of the location data, a compliance metric based on a set of compliance parameters, the compliance metric indicating a level of compliance for at least one offender for the time period; and performing at least one operation based on the compliance metric.

The details of one or more examples are set forth in the accompanying drawings and the description below. Other features, objects, and advantages of the disclosure will be apparent from the description and drawings, and from the claims.

BRIEF DESCRIPTION OF DRAWINGS

FIG. 6 is an illustration of a chart that contains compliance metrics for a plurality of monitored persons, in accordance with techniques of this disclosure.

DETAILED DESCRIPTION

Figure 1:
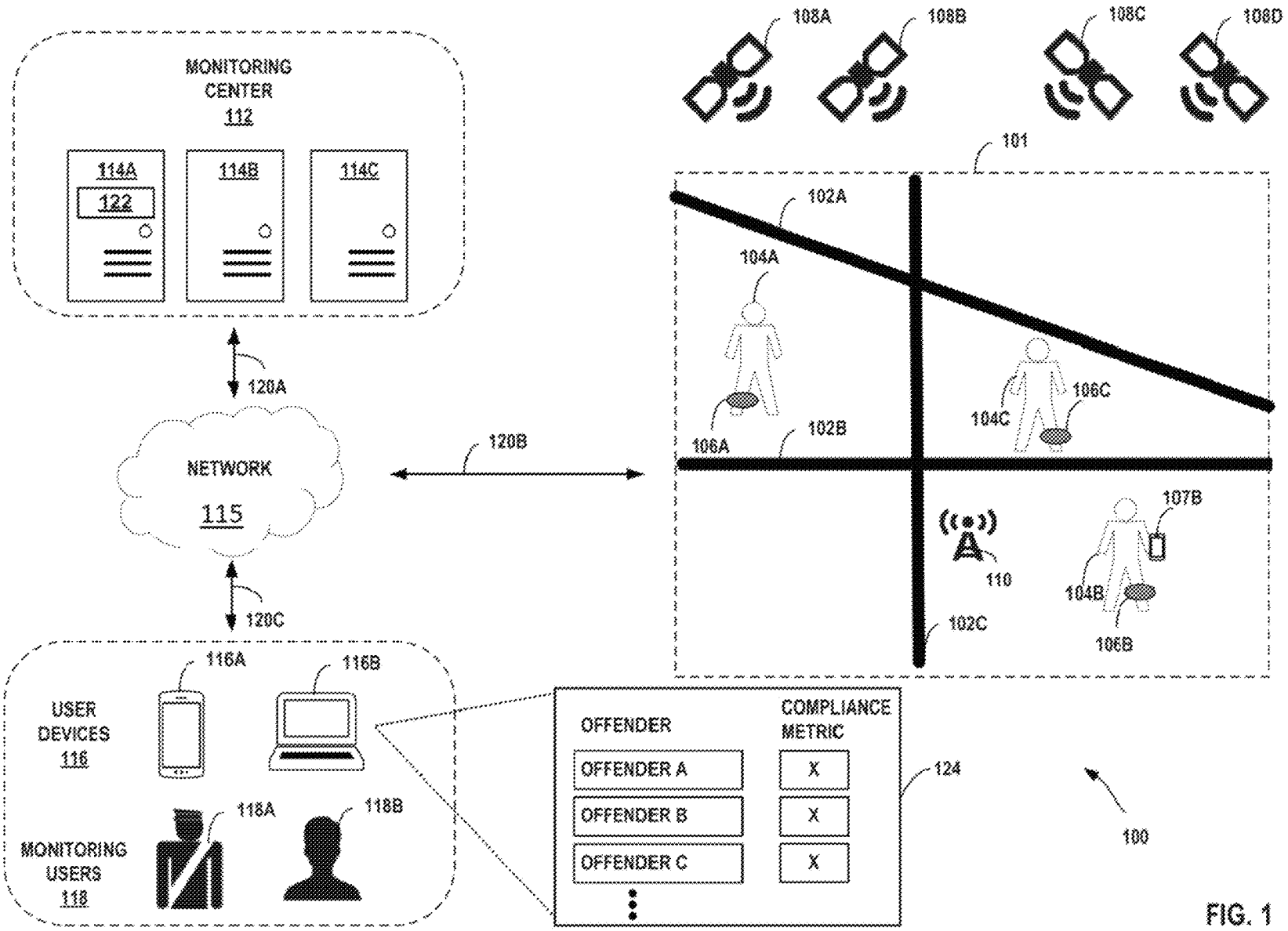
FIG. 1 illustrates an example system for determining one or more values that represent a monitoring attribute for one or more body-worn tracking devices, in accordance with techniques of this disclosure.

In an offender monitoring system, each offender may be assigned a device (e.g., a body-worn tracking device (BWTD)) that determines and stores a variety of data such as location, speed, heading, or the like at prescribed intervals (e.g., every minute). The device may alert an administrator at a supervising agency, such as a parole officer, when data from the BWTD is in violation of a rule assigned to the BWTD, e.g., when an offender violates the terms of his or her parole (e.g., by entering prohibited geographical zones). Data that represents whether an offender is in compliance with a particular rule is typically binary in nature. That is, an offender is typically either in compliance with rules assigned to a BWTD or not in compliance with the rules.

The techniques of this disclosure may utilize past and/or present data from BWTDs to determine how well a user wearing BWTD is complying with established rules or desired behaviors. For example, the techniques of this disclosure include determining a compliance metric based on a set of compliance parameters. The compliance parameters may correspond to any characteristic of a BWTD or a user wearing the BWTD that may be determined based on data gathered from the BWTD and that may be of interest to a party monitoring the BWTD (and the user wearing the BWTD). As described in greater detail herein, compliance parameters may include proximity to geographic zones or points/people of interest, operating characteristics of the BWTD, or a wide variety of other parameters representing characteristics, behaviors, or rules for a BWTD or person having a BWTD.

A compliance metric may generally refer to a value that represents a measure of one or more compliance parameters. For example, a compliance metric may be any quantitative value that provides a measure of compliance, which may provide an indication as to whether the user with a BWTD is complying with established rules or desired behaviors. The compliance metric may be time based. For example, the compliance metric may be determined for a time period that includes a plurality of instances of location data from at least one BWTD. Hence, the compliance metric may provide a non-binary representation of whether user with a BWTD is in compliance with a particular parameter. That is, rather than a simple binary indication of whether a compliance parameter has been complied with (e.g., no violation corresponds to a "0" and a violation corresponds to a "I"), the compliance metric may provide an indication as to how well a user with a BWTD is complying with compliance parameters, e.g., on a scale of more than two potential compliance metric values.

In some examples, according to aspects of this disclosure, the set of compliance parameters that contribute to a compliance metric may be weighted. For example, the weights applied to compliance parameters may be determined based on a perceived importance to the compliance metric. For example, a monitoring administrator may determine that a particular compliance parameter is relatively more or less important than another compliance parameter and may assign respective weights in accordance with the determined importance. In this example, the compliance metric may be a weighted compliance score that is an aggregation of the set of weighted compliance parameters.

In this way, the techniques of this disclosure include determining a compliance metric that provides a non-binary representation of compliance, e.g., how well a user wearing or carrying a BWTD is complying with established rules or desired behaviors. In some examples, the techniques may be used to determine whether the behavior of a monitored person is improving. For example, a rising compliance metric over a period of time may indicate that a monitored person is successfully rehabilitating. In other examples, the techniques may be used to determine if (and when) a monitored person may commit another crime. As described herein, the techniques may include monitoring a compliance metric for a monitored person and issuing a notification or alert based on the compliance metric indicating pending or potential deviations from a monitored person's course of rehabilitation.

FIG. 1 illustrates an example system 100 for determining one or more values that represent a monitoring attribute for one or more body-worn tracking devices, in accordance with techniques of this disclosure. FIG. 1 illustrates a geographic region 101, which may be a portion of the Earth's surface. Geographic region 101 includes multiple roads 102A-102C ("roads 102") on which monitored persons may travel. Geographic region 101 may include human (e.g., houses, buildings, and the like) and/or natural structures (trees, mountains, oceans, lakes, and the like). In some examples, geographic region 101 may be visually represented in a map, which may be two- or three-dimensional. Such maps may be output for display by computing devices as further described in this disclosure. In the example of FIG. 1, a map generated based on geographic region 101 may be visually similar in appearance to the representation of geographic region 101 as illustrated in FIG. 1.

System 100 may track the location of one or more monitored persons 104A-104C (collectively, monitored persons 104). A monitored person may be any person wearing a BWTD, such as BWTD's 106A-106C (collectively, BWTDs 106) which are respectively worn by monitored persons 104A-104C. In other examples, a "monitored person" may be interpreted as a non-human object to which a BWTD is attached. For instance, a monitored person may also be a vehicle, animal, or any other object that may or may not be move to different locations in a geographic area. In examples where a monitored person is non-human, the BWTD may be any device that is attached to, accompanies or is otherwise physically associated with the movable object, even if not necessarily bodily worn.

In the example of FIG. 1, monitored persons 104 may be released criminal offenders, although in other examples monitored persons may be any person. Released criminal offenders may include criminal offenders who have been suspected, accused, or convicted of a crime and released from a jail or prison. In such scenarios, system 100 may monitor the location of monitored persons 104. For instance, when monitored person 104A is released from jail or prison, a BWTD may be attached by law enforcement to the body of monitored person 104A. As further described in this disclosure, the BWTD may have a unique device identifier that is associated with personally identifying information of monitored person in a monitor center. In this way, as monitored person 104A moves to different locations in a geographic region, geographic location points generated by the BWTD and stored at the monitoring center may be associated with or otherwise attributed to monitored person 104A, such that the location and/or whereabouts of person 104A may be monitored.

In the example of FIG. 1, each of monitored persons 104A-104C are respectively wearing a BWTD 106A-106C. BWTD 106A-106C may have similar or the same functionality and construction. BWTD 106A may be a portable computing device that determines the location of a monitored person and reports such locations to a monitoring center or other physically separate computing device. BWTD may include a physical housing constructed of plastic or any other suitable material. The housing may include electronics such as, but not limited to: one or more computer processors, one or more memories, one or more wired and/or wireless communication devices (e.g., Global Positioning System (GPS) component, cellular or other network communication component, WiFi component, short-range (e.g., NFC, Bluetooth component, USB component), one or more output devices (e.g., haptic feedback component, lights, user interface display components, audio components), power sources (e.g., battery, power supply), and one or more printed circuit boards that physically, communicatively, and/or electronically couple such electronic devices to one another within the housing of the BWTD.

A BWTD may determine location information via GPS. While references are made herein to GPS, it should be understood that the techniques are equally applicable to any global navigation satellite system (GNSS). In some examples, a BWTD is a one-piece design in which GPS communication hardware and all other hardware for the BWTD are included in a single physical housing. In other examples, a BWTD may be a two-piece design. For example, in some instances, a BWTD may not include GPS communication hardware, which is physically separate from but in communication with the BWTD. For instance, the monitored person may carry a physical device with GPS communication hardware (e.g., such as a telephone having GPS functionality), and separately the BWTD may be attached to the monitored person and in communication with the GPS communication hardware. Further details of the components included within a BWTD are illustrated and described in FIG. 3.

In some examples, BWTD 106A may further include a combination of software components and hardware components to perform one or more monitoring functions. For instance, BWTD 106A may include tracking component comprised of hardware and/or software that communicates with the GPS hardware component to determine and record GPS coordinates of BWTD 106A. In some examples, the location components sends such GPS coordinates of BWTD 106A to a monitoring center or other physically separate computing device.

BWTD 106A may include any notification component comprised of hardware and/or software that compares GPS coordinates of BWTD 106A to a set of restricted locations and/or regions and generates notifications. A restricted region may be a region in which a monitored person may not enter and a restricted location may be a location from which the monitored person (and therefore BWTD) must be separated from by at least a defined or specified distance. Data stored on a BWTD that define restricted locations and/or regions may be provided by a monitoring center or any other computing device that is physically separate from BWTD 106A.

BWTD 106A may include a communication component comprised of hardware and/or software that sends and receives data through a network such as a Wi-Fi, ZigBee, Low Power Wide Area (LoRa), cellular, or other network. The communication component may initiate, manage, and terminate communication sessions between network infrastructure and BWTD 106A. Network infrastructure may provide a wireless network for data communication to and from BWTD 106A over a geographically distributed area. In some examples, network infrastructure may be owned and operated by a third-party, wireless or cellular carrier provider. Examples of such networks may include a set of one or more geographically dispersed towers with radios, antennas and/or other communications components that provide for data communication with BWTD 106A using one or more protocols such as 2G, 3G, 4G, Long-Term Evolution (LTE), LoRa or any other suitable protocol. As BWTD 106A moves into and out of proximity of different towers, BWTD 106A may initiate and terminate communication sessions between BWTD 106A and the various towers, where a tower may be a Base Station Transceiver in a wireless communication network, such as a cellular network.

In some examples, BWTD 106A may include configuration component comprised of hardware and/or software to manage BWTD 106A. The management module may write data to memory of BWTD 106A that is received from a monitoring center or other physically separate computing device. Data may include restricted regions and/or restricted locations, configuration data to configure one or more components of BWTD 106A, information that uniquely identifies BWTD 106A and/or monitored person 104A that is wearing BWTD 106A, or any other suitable information.

Components such as the location component, enforcement component, communication component, and management component may perform operations described herein using software, hardware, firmware, or a mixture of both hardware, software, and firmware residing in and executing on BWTD 106A or at one or more other remote computing devices. In some examples, BWTD 106A may execute its various components when embodied in software with one or more processors to perform the functionality described in this disclosure. BWTD 106A may execute any of such components as or within a virtual machine, userspace application, operating system or any other operating environment executing on underlying hardware.

In some examples, as described herein, BWTDs 106 may include multiple components. For example, BWTD 106B illustrates a two-piece BWTD that includes BWTD 106B and an end-user computing device 107B. End-user computing device 107B may be a computing device including, but not limited to a laptop computer, a tablet computer, a smartphone, a desktop computer, a server computer, a body worn computer (e.g., smartwatch, head-mounted device), or any other suitable computing device. End-user computing device 107B may be configured to interface with BWTD 106B to provide the functionality described herein with respect to BWTDs.

As shown in FIG. 1, system 100 may include one or more satellites 108A-108D ("satellites 108"). In some examples satellites 108 may comprise a set of global navigation satellites in a global navigation satellite system (GNSS). Satellites 108 continuously transmit their current time and position. As described above, BWTD 106A may include a GPS component that monitors multiple satellites to determine the position of BWTD 106A. Although only four satellites 108A-108D are shown, different numbers of satellites may be used by BWTD 106A to determine the GPS coordinates of BWTD 106A at a point in time.

System 100 may also include one or more towers, such as tower 110 that form network infrastructure. Tower 110 may include a physical structure that supports antennae, a GPS receiver, one or more sets of digital signal processors, transceivers, and control electronics, which collectively operate to establish sessions with end-user devices such as BWTDs, smartphones, or any other computing device. Tower 110, together with one or more other towers that include similar functionality, may be geographically dispersed, such as to provide a geographically dispersed wireless network for voice and/or data communication. Tower 110 and switching infrastructure (not shown) may be owned and operated by wireless carrier providers that charge customer/subscribers fees to operate on the wireless carrier provider.

Figure 2:
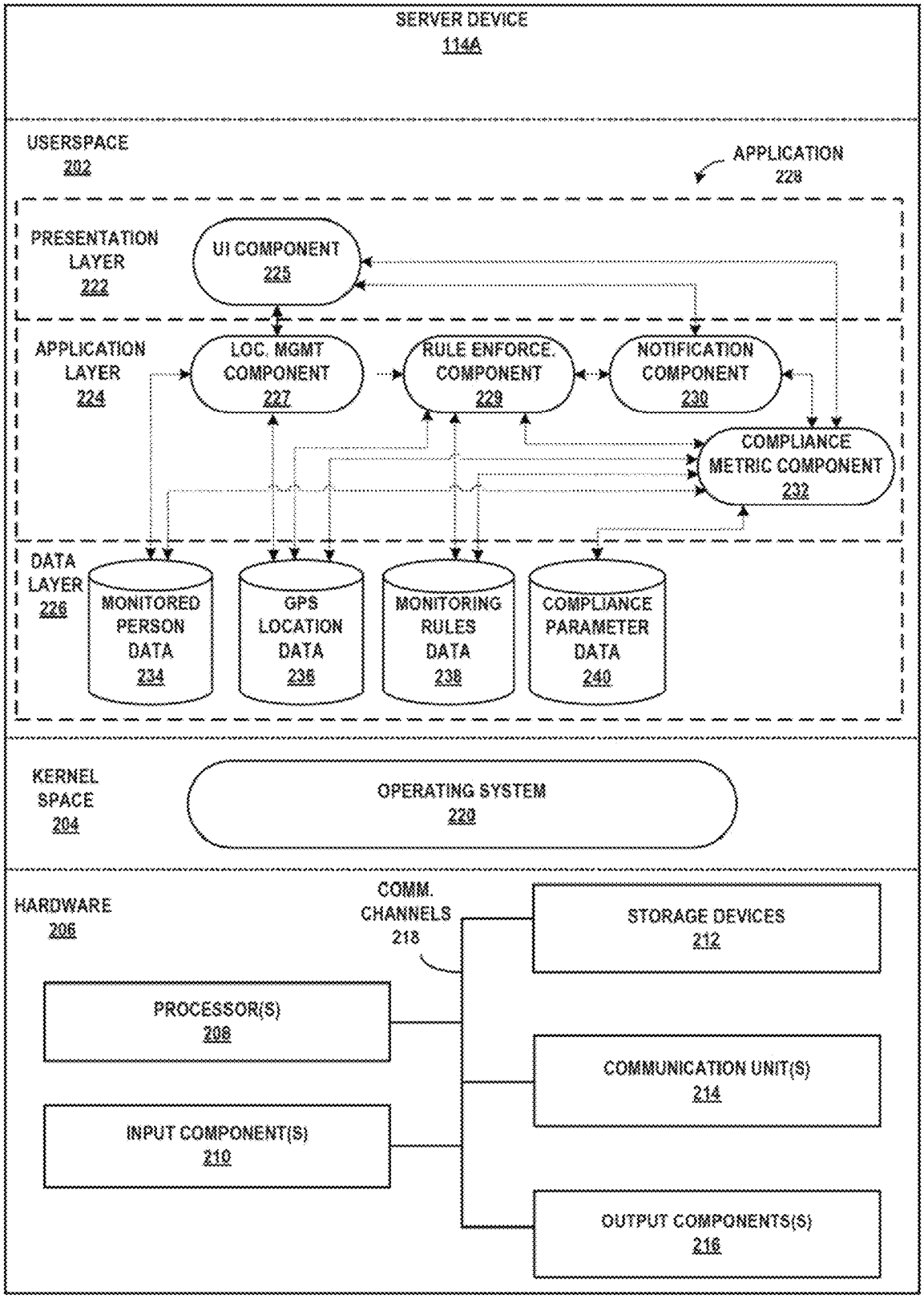
FIG. 2 is a block diagram illustrating an example computing device, in accordance with one or more aspects of the present disclosure.

FIG. 1 also includes monitoring center 112. Monitoring center 112 may be owned and operated by a private entity or a government entity. Monitoring center 112 may include one or more computing devices, such as server devices 114A-114C ("server devices 114"). Further details of the components included within server devices 114 is illustrated in FIG. 2. Server devices 114 may collectively provide a data center to monitor and track monitored persons based on, among other data, GPS coordinates of BWTDs that are provided to servers 112.

In some examples, server devices 114 may store an association between a monitored person and a respective BWTD worn by the monitored person. For instance, at the time that a law enforcement officer attaches a BWTD to the monitored person, the law enforcement officer may, using a separate, end-user computing device in communication with monitoring center 112, provide user input that creates an association between a unique identifier of the monitored person and a unique identifier of the BWTD. For instance, the association may be stored as a record in a database. As GPS coordinates are received by monitoring center 112 from the BWTD with the unique identifier of the BWTD, monitoring center 112 may store such GPS coordinates in association with the unique identifier of the BWTD. In this way, an operator of monitoring center 112 may determine the GPS coordinates associated with a particular monitored person.

Monitoring center 112 may receive configuration input from users, such as law enforcement officers, that define restricted locations and restricted regions. Such configuration input may be sent by a computing device of the user to monitoring center 112 via network 115. The configuration input may specify a unique identifier of the monitored person and/or BWTD and may also include properties such as named locations, perimeters, GPS coordinates or any other properties that may be used to define a restricted location and/or restricted region. By associating restricted locations and/or regions with a BWTD and/or monitored person wearing the BWTD, monitoring center 112 can determine violations, such as, determining whether a monitored person is operating within a restricted region and/or within a prohibited distance of a restricted location (e.g., a violation).

In some examples, monitoring center 112 determines that a monitored person is in violation of a restricted location or region, monitoring center may send one or more notifications. In some examples, monitoring center 112 may send a notification via network 115 to the BWTD for the violation, which may cause the BWTD to output an alert (e.g., haptic, visual, and/or audio feedback). In some examples, monitoring center 112, in response to detecting a violation, may send notifications to one or more other users, who may be associated with the monitored person who is in violation. For instance, to determine the one or more other users associated with the monitored person, monitoring center 112 may store within a record of a database a unique identifier of a law enforcement officer in association with a unique identifier of a monitored person.

Monitoring center 112 may generate user interfaces for display, such as maps that indicate different locations at which a monitored offender has been physically present. In some examples, monitoring center 112 may illustrate different locations at which a monitored offender has been physically present over a period of time. Monitoring center 112 may output any data that is stored in any suitable format including still and moving image data, audio data, and the like.

System 100 also includes user devices 116A-1168 ("user devices 116") and monitoring users 118A-118B ("monitoring users 118") who use user devices 116. User devices 116 may be a computing device including, but not limited to a laptop computer, a tablet computer, a smartphone, a desktop computer, a server computer, a body worn computer (e.g., smartwatch, head-mounted device), or any other suitable computing device. User devices 116A and 116B may have similar or the same components and functionality, in some examples.

User device 116A may include one or more components comprised of a combination of hardware and software. For instance, user device 116A may execute a monitoring application implemented in software and executable on hardware of user device 116A. The monitoring application may provide notifications of violations, maps or other visual representations of monitored offender locations based on real-time or past-generated GPS coordinates. The monitoring application may also generate and send a link that associates a unique identifier of a BWTD with a unique identifier of a monitored person. In some examples the monitoring application may natively implement functionality described in this disclosure, while in other examples the monitoring application may be a web-browser that accesses a web-based application with such functionality via a web-hosted application executing at monitoring center 112.

Monitoring users 118 may include law enforcement, parole officers, or any other public safety officials or employees. In some examples, monitoring users 118 may also include non-public safety offices/employees, such as past or potential victims of a monitored offender, school administrators, or any other potential user that may be interested in or need to know of the location or violations of a monitored offender. Monitoring users 118 may receive notifications by using user devices 116, which are sent by monitoring center 112.

Network 115 may represent a publicly accessible computer network that is owned and operated by a service provider, which is usually large telecommunications entity or corporation. Although not illustrated, service provider network 115 may be coupled to one or more networks administered by other providers, and may thus form part of a large-scale public network infrastructure, e.g., the Internet. Network 115 may provide computing devices such as BWTD, user devices, and monitoring center 112 with access to the Internet, and may allow the computing devices to communicate with each other. In some examples, network 115 may include one or more local area networks (LANs), such as user device devices 116 may communicate with monitoring center 112 through the Internet and/or a LAN on which both monitoring center 112 and user devices 116 are included.

Although additional network devices are not shown for ease of explanation, it should be understood that network 115 and system 100 may comprise additional network and/or computing devices such as, for example, one or more additional switches, routers, hubs, gateways, security devices such as firewalls, intrusion detection, and/or intrusion prevention devices, servers, computer terminals, laptops, printers, databases, wireless mobile devices such as cellular phones or personal digital assistants, wireless access points, bridges, cable modems, application accelerators, or other network devices. It should be understood that one or more additional network elements may be included along any of network links 120A-120C, such that the devices of system 100 are not directly coupled. Network links 120A-120C may be wired or wireless communication links, such as 100 Mbps, 1 Gbps, or 10 Gbps WiFi connections and/or physical cable connections, to name only a few examples.

In operation, in order to monitor a released criminal offender, such as monitored person 104A, a law enforcement officer, such as monitoring user 118A, may attach BWTD 106A to the ankle of monitored person 104A. In some examples, BWTD 106A may include a tamper-resistant strap that binds BWTD 106A to monitored person 104A. BWTD 106A may include one or more components comprised of hardware and/or software that detect if either the tamper-resistant strap and/or the housing/internal components of BWTD 106A have been tampered with by a monitored offender or other person. If BWTD 106A detects that tampering is or has occurred, then BWTD 106A may send a message via network 115 to monitoring center 112 to indicate the tampering event.

Upon attaching BWTD 106A to the ankle of monitored person 104A, monitoring user 118A may provide one or more user inputs to user device 116B that define an association between BWTD 106A and monitored person 104 in monitoring center 112. User device 116B, for example, may output for display a graphical user interface. The graphical user interface may include one or more user interface components, such as input fields, dropdown menus, labels or text fields, or any other graphical component through which a user may interact with user device 116B.

In the example of FIG. 1, monitoring user 118A may provide one or more inputs that specify or select a unique identifier of BWTD 106A and may further provide one or more user inputs that specify or select a unique identifier of monitored person 104A. Upon specifying or selecting the unique identifiers of BWTD 106A and/or monitored person 104A, monitoring user 118A may provide one or more user inputs to define an association between the respective unique identifiers. User device 116A may send one or more messages to monitoring center 112 that define in data, the association between the unique identifier of monitored person 104A and BWTD 106A.

In some examples, monitoring user 118A may specify other data in monitoring center 112 that is associated with BWTD 106A and/or monitored person 104A. Such data may include rules for data from BWTD 106A that define prohibited activities or behaviors for a monitored person 106A. Monitoring center 112 (or BWTD 106A) may generate a notification or an alert based on data from BWTD 106A that does not conform to the rules.

For instance, monitoring user 118A may provide one or more user inputs at user device 116A that specify restricted locations and/or restricted regions. Monitoring user 118A may provide one or more user inputs at user device 116A that specify permissible times or distances that a monitored person is allowed to travel or otherwise move about. Monitoring user 118A may provide one or more user inputs at user device 116A that specify one or more permissible locations and/or permissible regions. A permissible region may be a bounded region in which a monitored person must remain within and a permissible location may be a location from which the monitored person (and therefore BWTD) must be within at least a defined or specified distance. User device 116A may send one or more messages to monitoring center 112 with the data specified by monitoring user 118A, and monitoring center 112 may configure or associate the data with the unique identifier of monitored person 104A and BWTD 106A.

Upon monitoring user 118A attaching to and configuring BWTD 106A with monitored person 104A, monitored person 104A may be released from custody into the general public (i.e., released from a confined or restricted condition, such as a jail, prison, or courthouse). As monitored person 104A moves throughout a geographic region, such as geographic region 101, BWTD 106A determines respective GPS locations of BWTD 106A and sends messages to monitoring center 112 that include at least a unique identifier of BWTD 106A and/or monitored person 104A, unique tower identifier, GPS coordinates (latitude, longitude), and timestamps for when each respective GPS coordinate has been determined. BWTD 106A may send such messages through wireless communication with tower 110, which in turns sends the messages to monitoring center 112 via network 115, and in some examples one or more additional, intermediate networked devices (not shown in FIG. 1).

In this way, monitoring center 112, determines and stores the locations of monitored person 104A over time. Monitoring center 112 may determine whether monitored person 104A is in violation of a restricted location/region, a permissible location/region, a time period for permitted travel with respect to a restricted/permissible location/region, or any other property, rule, condition, or otherwise defined within or specified at monitoring center 112. As noted above, one of server devices 114 may issue a notification or alert based on the occurrence of an event, such as upon determining that monitored person 104A has traveled to a restricted region (e.g., as indicated by location data from BWTD 106A). However, conventional monitoring techniques may not provide a comprehensive representation of the behavior of a monitored person.

According to aspects of this disclosure, monitoring center 112 may determine one or more compliance metrics 122 based on a set of compliance parameters for monitored persons 104. In the example of FIG. 1, monitoring center 112 may store compliance metrics 122 to one of service devices 114. As described herein, compliance metrics 122 may be any quantitative value that provides a measure of compliance, which may provide an indication as to whether the user with a BWTD is complying with established rules or desired behaviors.

Compliance metrics 122 are based on a set of one or more compliance parameters, which may correspond to any characteristic of BWTDs 106 or monitored persons 104 that may be of interest to monitoring users 118. For example, compliance parameters may be associated with permitted or prohibited geographical regions, time periods, proximities to locations or persons of interest, or the like. Compliance parameters may additionally or alternatively be associated with permitted or prohibited operating conditions of BWTDs 106 (e.g., a battery status of BWTDs 106, a wireless, cellular or satellite signal status of BWTDs 106, a condition of a restraint of BWTDs 106, or the like). In some instances, compliance parameters may be based on conditions of release or parole. However, compliance parameters are not necessarily limited to conditions of release or parole.

Compliance parameters contributing to compliance metrics 122 may be based on data from BWTDs 106. Such data may be referred to herein as "characteristic data." For example, characteristic data may be any data from BWTDs 106 that indicates a trait, quality, or property of BWTDs 106 and/or monitored persons 104. As examples, BWTDs 106 may generate characteristic data that indicates a unique identifier of BWTDs 106 and/or monitored persons 104, a geo-location of BWTDs 106 (e.g., GPS coordinates), a time at which location data is gathered (e.g., timestamp data), a receive signal strength of one or more navigational satellites (e.g., GPS receive signal strength), a signal strength of a communication tower, a directional heading, a speed, whether BWTDs 106 are at rest, an ambient temperature in which BWTDs 106 are located, whether BWTDs 106 are in motion without a GPS signal, whether a housing or tamper-resistant strap of BWTDs 106 has been tampered with, or the like. It should be understood that the examples noted above is not an exhaustive list, and BWTDs 106 may generate other data that indicates a variety of other characteristics of BWTDs 106 and/or monitored persons 104.

As noted above, compliance parameters may correspond to any characteristic of BWTDs 106 or monitored persons 104 that may be of interest to monitoring users 118. As one example, a compliance parameter may include a zone compliance parameter. The zone compliance parameter may indicate whether one of BWTDs 106 (such as BWTD 106A for purposes of example) is in proximity to a forbidden zone. Monitoring center 112 may determine, for a number of instances of location data from BWTD 106A (e.g., over a time period), a numerical value that indicates a level of compliance as the zone compliance parameter. For example, monitoring center 112 may determine a relatively high value based on data that indicates that BWTD 106A stayed relatively far from the forbidden zone and a relatively low value based on data that indicates that BWTD 106A was in close proximity to the forbidden zone, or vice versa.

As another example, a compliance parameter may include a location compliance parameter. The location compliance parameter may indicate whether one of BWTDs 106 (such as BWTD 106A for purposes of example) is in an approved location at an approved time of day. Monitoring center 112 may determine, for a number of instances of location data from BWTD 106A (e.g., over a time period), a numerical value that indicates a level of compliance as the location compliance parameter. For example, monitoring center 112 may determine a relatively high value based on data that indicates that BWTD 106A was located in approved locations at approved times and a relatively low value based on data that indicates that BWTD 106A was located in unapproved locations, or vice versa.

As another example, a compliance parameter may include a crime scene compliance parameter. The crime scene compliance parameter may indicate whether one of BWTDs 106 (such as BWTD 106A for purposes of example) is in proximity to a geographical area designated as being a crime scene. Monitoring center 112 may determine, for a number of instances of location data from BWTD 106A (e.g., over a time period), a numerical value that indicates a level of compliance as the crime scene compliance parameter. For example, monitoring center 112 may determine a relatively high value based on data that indicates that BWTD 106A stayed relatively far from locations of crime scenes and a relatively low value based on data that indicates that BWTD 106A was in close proximity to crime scene locations, or vice versa.

As another example, a compliance parameter may include an offender proximity compliance parameter. The offender proximity compliance parameter may indicate whether one of BWTDs 106 (such as BWTD 106A for purposes of example) is in proximity to one or more other BWTDs 106. For example, the offender proximity compliance parameter may indicate a density of BWTDs 106. Monitoring center 112 may determine, for a number of instances of data from BWTD 106A (e.g., over a time period), a numerical value that indicates a level of compliance as the offender proximity compliance parameter. For example, monitoring center 112 may determine a relatively high value based on data that indicates that BWTD 106A stayed relatively far from other BWTDs 106 and a relatively low value based on data that indicates that BWTD 106A was in close proximity to other BWTDs 106, or vice versa.

As another example, a compliance parameter may include a temperature compliance parameter. For example, BWTDs 106 may transmit temperature data to monitoring center 112 that indicates an ambient temperature of an environment in which BWTDs 106 are disposed. The temperature may indicate whether BWTD 106A is covered in a shielding material, whether monitored person 104A is outside or inside a building, or the like. Hence, the temperature compliance parameter may indicate the temperature of BWTD 106A. Monitoring center 112 may determine, for a number of instances of data from BWTD 106A (e.g., over a time period), a numerical value that indicates a level of compliance as the temperature compliance parameter. For example, monitoring center 112 may determine a relatively high value based on data that indicates that BWTD 106A had a temperature consistent with expected operating conditions (e.g., was near 70 degrees at a time when monitored person 104A was expected to be indoors) and a relatively low value based on data that indicates that BWTD 106A had a temperature inconsistent with expected operating conditions, or vice versa.

As another example, a compliance parameter may include a BWTD condition compliance parameter. The BWTD condition compliance parameter may indicate a condition or characteristic of one of BWTDs 106. For example, the BWTD condition compliance parameter may indicate, based on data received from BWTD 106A, a status of a battery of BWTD 106A, whether a restraint of BWTD 106A is intact, whether multiple components of a multi-component BWTD (such as BWTD 106B and end-user device 107B) are in proximity to one another, or other conditions of BWTDs 106. Monitoring center 112 may determine, for a number of instances of data from BWTD 106A (e.g., over a time period), a numerical value that indicates a level of compliance as the BWTD condition compliance parameter. For example, monitoring center 112 may determine a relatively high value based on data that indicates a condition of BWTD 106A was consistent with an expected or desired condition (e.g., a battery level was above a desired charge level, restraints remained intact, components were in communication, or the like) and a relatively low value based on data that indicates that a condition of BWTD 106A was not in an expected or desired condition, or vice versa.

As another example, a compliance parameter may include a movement compliance parameter. The movement compliance parameter may indicate whether the movement of one of BWTDs 106 (such as BWTD 106A for purposes of example) is consistent with expected or desired movements. For example, BWTDs 106 may be configured to include a variety of movement sensors such as accelerometers, gyroscopes, and/or inertial measurement units (IMUs) and may be configured to transmit movement data to monitoring center. Based on the movement data, monitoring center 112 may determine, for a number of instances of movement data (e.g., over a time period), a numerical value that indicates a level of compliance as the movement compliance parameter. For example, monitoring center 112 may perform activity recognition based on received movement data. In an example, for purposes of illustration, monitoring center 112 may determine that monitored person 104A is driving and determine whether monitored person 104A is driving at a speed consistent with the speed limit. Monitoring center 112 determine a relatively high value based on data that indicates that movement of BWTD 106A is consistent with expected or desired values and a relatively low value based on data that indicates that BWTD 106A is inconsistent with expected or desired values, or vice versa.

It should be understood that the examples provided for purposes of illustration, and that a wide variety of other compliance parameters are also possible.

According to aspects of this disclosure, monitoring center 112 may apply a weight to respective compliance parameters of the set of compliance parameters to form a set of weighted compliance parameters. For example, one of monitoring users 118 may assign weights to compliance parameters (e.g., via user devices 116) based on a perceived importance of the compliance parameters. In some instances, the weights may be based on conditions of release or parole.

In an example for purposes of illustration, a first location compliance parameter may indicate, based on data from BWTD 106A, whether monitored person 104A is located at school during school hours (e.g., how consistently monitored person 104A is attending classes). A second location compliance parameter may indicate, based on data from BWTD 106A, whether monitored person 104A is located at a rehabilitation meeting at the appropriate time (e.g., how consistently monitored person 104A is attending rehabilitation meetings). In some instances, the second location compliance parameter may be weighted more heavily than the first location compliance parameter, because it may be relatively more important for purposes of rehabilitation (and/or based on conditions or release or parole) that monitored person 104A attends rehabilitation meetings than classes.

In some examples, monitoring center 112 may apply weights to compliance parameters based on a case history (e.g., a history of events) associated with the monitored person being evaluated. For example, monitoring center 112 may apply relatively lower or higher weights to compliance parameters based on a history of compliance with the compliance parameters. That is, as an example, monitoring center 112 may apply relatively higher weights to compliance parameters that have not been complied with in the past.

In some instances, monitoring center 112 may apply an initial set of weights to compliance parameters. One of monitoring users 118 may then adjust the initial set of weights based on, as examples, the case history of the monitored person, familiarity with the behaviors or habits of the monitored person, or other factors. In other instances, monitoring users 118 may be responsible for entering the initial set of weights. As described in greater detail with respect to the example of FIG. 4 below, monitoring user 118 may input the weights via user selectable elements of a graphical user interface (GUI) presented at user devices 116.

Weights for compliance parameters may take a variety of forms. In some examples, monitoring center 112 may apply a scalar weight to respective compliance parameters. For example, monitoring center 112 may determine a weight from an array of weights for a particular compliance parameter. In a simple example for purposes of illustration, the weight may be a numerical value in a range from 0 to 100. In other examples, monitoring center may apply a discrete weight to respective compliance parameters. For example, monitoring center 112 may determine, based on input from one of monitoring users 118, a weight represented by a "low," "medium," or "high" ranking.

According to aspects of this disclosure, monitoring center 112 may determine compliance metrics 122 based on any aggregation of compliance parameters. In one example, monitoring center 112 may determine a compliance metric 122 based on a sum of products. That is, monitoring center 112 may multiply respective compliance parameters by respective weights thereby forming respective products and sum the respective products. In other examples, monitoring center 112 may determine compliance metrics by applying any variety of mathematical functions to compliance parameters (that may or may not be weighted). The mathematical functions may be linear (e.g., linear regression) or non-linear (e.g., neural network).

For example, in general, compliance metric 122 may be calculated through any mathematical function that accepts compliance parameters as input factors, denoted as x_1, . . . x_n in the example of Equation (1) below, such that:

$$CM=f(x_1,x_2, \ldots x_n) \tag{1}$$

The mathematical function f, mentioned above, may have several tuning (or weighting) parameters that may impact on how the input factor "x_i" impacts on the compliance metric. For instance, in case of using logistic regression (exp) as the function f( ), the role of these tuning (or weighting) operation may be described as:

$$f(x_1,x_2, \ldots ,x_n)=: \exp(-(w_1*x_1+w_2*x_2+ \ldots +w_n*x_n))$$

In case of linear regression, it would be:

$$f(x_1,x_2, \ldots ,x_n)=w_1*x_1+w_2*x_2+ \ldots +w_n*x_n$$

In case of a decision tree, additional tuning variables may be included to determine the threshold on each variable, such as:

$$f(x_1,x_2, \ldots ,x_n)=w_1*U(x_1-T_1)+w_2*U(x_2-T_2)+ \ldots +w_n*U(x_n-T_n)$$

where U(Y) is equal 1 whenever Y>=0 and is equal 0 whenever Y<0. Therefore, U(x_i−T_i) is equal 1 whenever x_i>=T_i, and it is 0 otherwise.

It should be understood that there may be a variety of other functions for input variables x_1, x_2, . . . , x_n that may accept tuning variables to calculate compliance metric 122, and the examples above are provided for purposes of illustration only.

In some examples, monitoring center 112 may determine compliance metrics 122 based on a plurality of other compliance metrics 122. For example, monitoring center 112 may determine a number of compliance metrics 122 over a period of time. Monitoring center 112 may aggregate the number of compliance metrics 122 to generate a representative compliance metric 122 for the period of time, e.g., such as by averaging or applying another mathematical function to the number of compliance metrics 122. In some instances, monitoring center 112 may fit a mathematical trend to a plurality of compliance metrics 122 in order to determine a representative compliance metric 122 for a time period.

According to some aspects, monitoring center 112 may compare compliance metrics 122 for a plurality of monitored persons 104. For example, monitoring center 112 may rank compliance metrics 122 for a plurality of monitored persons 104, such that monitored persons 104 associated with a relatively higher compliance metric 122 are ranked higher (or lower) than monitored persons associated with a relatively lower compliance metric 122. In some instances, compliance metrics 122 may be normalized prior to the comparison. That is, for example, monitoring center 112 may adjust compliance metrics 122 that are determined based on different compliance parameters in order to generate comparable compliance metrics 122.

According to some aspects, monitoring center 112 perform at least one operation based on compliance metrics 122. For example, monitoring center 112 may maintain threshold compliance metrics 122 and/or combinations of compliance metrics 122. Monitoring center 112 may generate and transmit notifications based on compliance metrics 122 being above or below the threshold values. In some examples, monitoring center 112 may send a notification via network 115 to the BWTD for the violation, which may cause the BWTD to output an alert (e.g., haptic, visual, and/or audio feedback). In other examples, monitoring center 112 may send notifications to one or more monitoring users 118, who may be associated with or responsible for the monitored person who is in violation.

In some examples, monitoring center 112 may adjust monitoring parameters based on compliance metrics 122. For example, in instances in which one or more compliance parameters 122 for one of monitored persons 104 indicates a high (or low) level of compliance, monitoring center 112 may adjust monitoring parameters accordingly. In an example for purposes of illustration, monitoring center 112 may increase (or decrease) a sampling rate with which location or other data samples are gathered from BWTDs 106. Adjustment in the rate of sampling may result in a decreased (or increased) rate of battery discharge of a battery of BWTDs 106, which may be a convenience factor for monitored persons 104.

In some examples, monitoring center 112 may generate an electronic message that includes suggestions for improving a compliance metric and transmitting the electronic message to the appropriate monitored person 104. For example, after determining a compliance metric 122 for monitored person 104A, monitoring center 112 may generate an electronic message that includes suggestions for improving the compliance metric 122, e.g., based on high or low compliance parameters contributing to compliance metric 122. Monitoring center 112 may transmit the electronic message to BWTD 106A or another electronic device associated with monitored person 104A.

According to aspects of this disclosure, monitoring center 112 may perform an operation based on compliance metrics 122 that includes generating a graphical user interface (GUI) that includes a graphical representation of compliance metrics 122. In the illustrated example, monitoring center 112 may generate GUI 124 for transmission to and display by one or more of user devices 116. GUI 124 includes a graphical representation compliance metrics for a plurality of monitored persons 104 (offender A, offender B, offender C, . . . ). GUI 124 may include a ranking of compliance metrics 122 based on the values of compliance metrics 122.

In some examples, as described in greater detail with respect to the example of FIG. 6, monitoring center 112 may determine a group of compliance metrics 122 associated with a group of BWTDs 106. For example, the group may be based on BWTDs 106 assigned to a particular monitoring user 118 responsible for monitoring the group of BWTDs 106 (e.g., a parole officer responsible for monitoring a plurality of monitored persons 104 and associated BWTDs 106). In some instances, monitoring center 112 may determine, separately from the group of compliance metrics 122, an administrator score based on the group of compliance metrics 122. That is, for example, monitoring center 112 may determine an administrator score that indicates a level of compliance of monitored persons 106 for which the administrator is responsible.

While certain aspects of the example of FIG. 1 are described with respect to monitoring center 112, it should be understood that the techniques described herein may alternatively (or additionally) be performed by one or more other components of system 100. For example, while monitoring center 112 may typically be responsible for determining compliance parameters, weights, and compliance metrics 122, in other examples, such processing may be performed by BWTDs 106.

FIG. 2 is a block diagram illustrating an example computing device, in accordance with one or more aspects of the present disclosure. FIG. 2 illustrates only one particular example of server device 114A in monitoring center 112, as shown in FIG. 1. Many other examples of server device 114A may be used in other instances and may include a subset of the components included in example server device 114A or may include additional components not shown example server device 114A in FIG. 2. In some examples, server device 114A may be a server, tablet computing device, smartphone, wrist- or head-worn computing device, laptop, desktop computing device, or any other computing device that may run a set, subset, or superset of functionality included in application 228.

As shown in the example of FIG. 2, server device 114A may be logically divided into user space 202, kernel space 204, and hardware 206. Hardware 206 may include one or more hardware components that provide an operating environment for components executing in user space 202 and kernel space 204. User space 202 and kernel space 204 may represent different sections or segmentations of memory, where kernel space 204 provides higher privileges to processes and threads than user space 202. For instance, kernel space 204 may include operating system 220, which operates with higher privileges than components executing in user space 202.

As shown in FIG. 2, hardware 206 includes one or more processors 208, input components 210, storage devices 212, communication units 214, and output components 216. Processors 208, input components 210, storage devices 212, communication units 214, and output components 216 may each be interconnected by one or more communication channels 218. Communication channels 218 may interconnect each of the components 208, 210, 212, 214, and 216 for inter-component communications (physically, communicatively, and/or operatively). In some examples, communication channels 218 may include a hardware bus, a network connection, one or more inter-process communication data structures, or any other components for communicating data between hardware and/or software.

One or more processors 208 may implement functionality and/or execute instructions within server device 114A. For example, processors 208 on server device 114A may receive and execute instructions stored by storage devices 212 that provide the functionality of components included in kernel space 204 and user space 202. These instructions executed by processors 208 may cause server device 114A to store and/or modify information, within storage devices 212 during program execution. Processors 208 may execute instructions of components in kernel space 204 and user space 202 to perform one or more operations in accordance with techniques of this disclosure. That is, components included in user space 202 and kernel space 204 may be operable by processors 208 to perform various functions described herein.

One or more input components 210 of server device 114A may receive input. Examples of input are tactile, audio, kinetic, and optical input, to name only a few examples. Input components 210 of server device 114A, in one example, include a mouse, keyboard, voice responsive system, video camera, buttons, control pad, microphone or any other type of device for detecting input from a human or machine. In some examples, input component 210 may be a presence-sensitive input component, which may include a presence-sensitive screen, touch-sensitive screen, etc.

One or more output components 216 of server device 114A may generate output. Examples of output are tactile, audio, and video output. Output components 216 of server device 114A, in some examples, include a presence-sensitive screen, sound card, video graphics adapter card, speaker, cathode ray tube (CRT) monitor, liquid crystal display (LCD), or any other type of device for generating output to a human or machine. Output components may include display components such as cathode ray tube (CRT) monitor, liquid crystal display (LCD), Light-Emitting Diode (LED) or any other type of device for generating tactile, audio, and/or visual output.

Output components 216 may be integrated with server device 114A in some examples. In other examples, output components 216 may be physically external to and separate from server device 114A, but may be operably coupled to server device 114A via wired or wireless communication. An output component may be a built-in component of server device 114A located within and physically connected to the external packaging of server device 114A (e.g., a screen on a mobile phone). In another example, presence-sensitive screen may be an external component of server device 114A located outside and physically separated from the packaging of server device 114A (e.g., a monitor, a projector, etc. that shares a wired and/or wireless data path with a tablet computer). Output components 216 may provide haptic, vibratory or other tactile output.

One or more communication units 214 of server device 114A may communicate with external devices by transmitting and/or receiving data. For example, server device 114A may use communication units 214 to transmit and/or receive radio signals on a radio network such as a cellular or other wireless radio network. In some examples, communication units 214 may transmit and/or receive satellite signals on a satellite network such as a Global Positioning System (GPS) network. Examples of communication units 214 include a network interface card (e.g. such as an Ethernet card), an optical transceiver, a radio frequency transceiver, a GPS receiver, or any other type of device that can send and/or receive information. Other examples of communication units 214 may include Bluetooth®, GPS, 3G, 4G, and Wi-Fi® radios found in mobile devices as well as Universal Serial Bus (USB) controllers and the like.

One or more storage devices 212 within server device 114A may store information for processing during operation of server device 114A. In some examples, storage device 212 is a temporary memory, meaning that a primary purpose of storage device 212 is not long-term storage. Storage devices 212 on server device 114A may configured for short-term storage of information as volatile memory and therefore not retain stored contents if deactivated. Examples of volatile memories include random access memories (RAM), dynamic random access memories (DRAM), static random access memories (SRAM), and other forms of volatile memories known in the art.

Storage devices 212, in some examples, also include one or more computer-readable storage media. Storage devices 212 may be configured to store larger amounts of information than volatile memory. Storage devices 212 may further be configured for long-term storage of information as non-volatile memory space and retain information after activate/off cycles. Examples of non-volatile memories include magnetic hard discs, optical discs, floppy discs, flash memories, or forms of electrically programmable memories (EPROM) or electrically erasable and programmable (EEPROM) memories. Storage devices 212 may store program instructions and/or data associated with components included in user space 202 and/or kernel space 204.

As shown in FIG. 2, application 228 executes in userspace 202 of server device 114A. Application 228 may be logically divided into presentation layer 222, application layer 224, and data layer 226. Presentation layer 222 may include user interface (UI) component 124, which generates and renders user interfaces of application 228. Application layer 224 may include location management component (LMC) 227, rule enforcement component (REC) 229, notification component 230, and rule reconfiguration component (RRC) 232. Presentation layer 222 may include UI component 225.

Data layer 226 may include one or more datastores. A datastore may store data in structure or unstructured form. Example datastores may be any one or more of a relational database management system, online analytical processing database, table, or any other suitable structure for storing data. Monitored person data 234 may include information descriptive of monitored persons and/or monitoring users. Example data, may include unique identifier for monitored person or user, name, address, phone number, notes, or any other descriptive information of a monitored person or monitored person, such as a type of offense, a degree of offense (e.g., a legal degree of offense, such as second degree battery), or the like.

GPS location data 236 may include GPS locations of BWTDs and other data associated with the GPS locations. For instance, a record or other instance of GPS location data may include, but is not limited to, any one or more of: unique identifier of BWTD and/or monitored person wearing BWTD, timestamp, GPS coordinates (latitude, longitude), a receive signal strength of one or more navigational satellites (e.g., GPS receive signal strength), signal strength of communication tower, and directional heading of BWTD, speed at which a BWTD is traveling, whether a BWTD is at rest, an ambient temperature in which a BWTD is located, whether a BWTD is in motion without a GPS signal, or the like. The data included in a record or other instance of GPS location data in GPS location data 236 may be a tuple or set of data sent by a BWTD to monitoring center 112, as described in FIG. 1.

Data layer 226 also includes monitoring rules data 238. Monitoring rules data 238 may include data that defines, one or more of: a restricted location/region, a permissible location/region, a time period for permitted travel with respect to a restricted/permissible location/region, permissible/restricted users who can or cannot be within a threshold distance of the monitored person, or any other property, rule, condition, to name only a few examples. In some instances, the monitoring rules defined by monitoring rules data 238 may be established based on conditions of release or parole of a monitored person. However, the monitoring rules need not be court mandated.

Data layer 226 also includes compliance parameter data 240. Compliance parameter data 240 may define compliance parameters for determining compliance metrics in accordance with the techniques of this disclosure. As described herein, compliance parameters may correspond to any characteristic of BWTDs or monitored persons wearing or carrying BWTDs that may be of interest to a monitoring party. For example, compliance parameters may be associated with permitted or prohibited geographical regions, time periods, proximities to locations or persons of interest, or the like. Compliance parameters may additionally or alternatively be associated with permitted or prohibited operating conditions of BWTDs 106 (e.g., a battery status of BWTDs 106, a wireless, cellular or satellite signal status of BWTDs 106, a condition of a restraint of BWTDs 106, or the like).

Compliance parameters of compliance parameter data 240 may be based on GPS location data 236, monitored person data 234 or other data, which may be referred to herein as characteristic data. Example compliance parameters include a zone compliance parameter, a location compliance parameter, a crime scene compliance parameter, an offender proximity compliance parameter, a temperature compliance parameter, a BWTD condition compliance parameter, a movement compliance parameter, or a wide variety of other compliance parameters.

Compliance parameter data 240 may also include weights for compliance parameters. For example, as described below, compliance metric component 232 may apply one or more weights to respective compliance parameters of a set of compliance parameters to form a set of weighted compliance parameters. Weights of compliance parameter data 240 may be determined based on, for example, a perceived importance of compliance parameters, conditions of release or parole, a history of events for a monitored person, or the like. Weights for compliance parameters may take a variety of forms, such as scalar weights, discrete weights, or the like.

In operation, BWTD 106A may be attached and assigned to monitored person 104A. LMC 227 may receive a unique identifier of BWTD 106A and/or a unique identifier of monitored person 104A. LMC 227 may store data defining an association between the unique identifier of BWTD 106A and the unique identifier of monitored person 104A. As monitored person 104A moves within one or more different geographic regions, LMC 227 may receive location data from BWTD 106A including, but not limited to: a unique identifier of BWTD 106A and/or monitored person wearing BWTD 106A, GPS coordinates (latitude, longitude), a timestamp when the GPS coordinates (latitude, longitude) were determined, GPS receive signal strength when the GPS coordinates (latitude, longitude) were determined, signal strength of a tower when the GPS coordinates (latitude, longitude) were determined, and/or a directional heading of BWTD 106A when the GPS coordinates (latitude, longitude) were determined. LMC 227 may store such location data within GPS location data 236.

According to aspects of this disclosure, compliance metric component 232 is configured to determine one or more compliance metrics based on a set of compliance parameters, e.g., from compliance parameter data 240. For example, compliance metric component 232 may determine compliance metrics based on any aggregation of compliance parameters from compliance parameter data. In some examples, compliance metric component 232 may be configured to apply weights to compliance parameters when determining a compliance metric.

In some examples, compliance metric component 232 may determine compliance metrics based on a plurality of other compliance metrics. For example, compliance metric component 232 may determine a plurality of compliance metrics 122 over a period of time and may aggregate the compliance metrics to generate a representative compliance metric for the period of time. In some examples, compliance metric component 232 may apply an averaging function or another mathematical function to the plurality of compliance metrics to determine the representative compliance metric.

According to some aspects, compliance metric component 232 may compare compliance metrics for a plurality of monitored persons, such as monitored persons 104 (FIG. 1). For example, compliance metric component 232 may rank compliance metrics for a plurality of monitored persons 104, e.g., from highest to lowest or vice versa. In some instances, compliance metric component 232 may normalize compliance metrics prior to the comparison. That is, for example, compliance metric component 232 may adjust compliance metrics in order to generate comparable compliance metrics 122.

REC 229 may determine whether any other property, rule, condition of monitoring rules data 238 is satisfied, which may include data that defines, one or more of: a restricted location/region, a permissible location/region, a time period for permitted travel with respect to a restricted/permissible location/region, permissible/restricted users who can or cannot be within a threshold distance of the monitored person, or any other property, rule, condition. For instance, REC 229 may determine whether any other property, rule, condition is satisfied based on receiving one or more of GPS locations from LMC 227, GPS location data 236, and monitoring rules data 238. REC 229 may cause notification component 230 to send a notification to user devices of one or more monitoring users, and the notification may indicate a violation.

According to aspects of this disclosure, REC 229 may further determine whether compliance metrics from compliance metric component 232 are above or below a threshold. For example, REC 229 may obtain threshold compliance metrics, e.g., from monitoring rules data 238. REC 229 may apply the thresholds to generate and transmit notifications based on compliance metrics being above or below the threshold values.

In some examples, REC 229 may adjust monitoring rules data 238 based on compliance metrics from compliance metric component 232. For example, in instances in which one or more compliance parameters for a monitored person indicates a high (or low) level of compliance, REC 229 may adjust monitoring parameters accordingly. In an example for purposes of illustration, REC 229 may increase (or decrease) a sampling rate with which location or other data samples are gathered from BWTDs.

Notification component 230 may receive data from REC 229 and compliance metric component 232 and send notifications (or messages) to computing devices external to server device 114A that cause such computing devices to output alerts, which may be visual, audio, haptic or any other type of discernable feedback. In this way, violations, statuses, or any other information may be communicated to devices of monitored persons and monitoring users. In some examples, events that cause notifications or messages to be sent by notification component 230 may also be logged by LMC 227, REC 229, and/or notification component 230 in monitored person data 234.

In some examples, notification component 230 may generate an electronic message that includes suggestions for improving a compliance metric and transmitting the electronic message to the appropriate monitored person. For example, notification component 230 may generate an electronic message that includes suggestions for improving a compliance metric from compliance metric component 232, e.g., based on high or low compliance parameters contributing to the compliance metric.

In some examples, UI component 225 may act as an intermediary between various components and modules of server device 114A to process and send input detected by input devices to other components and modules, and generate output from other components and modules that may be presented at one or more output devices. For instance, UI component 225 may generate one or more user interfaces for display, which may include data and/or graphical representations of maps, alerts, reports, or other communications as described in this disclosure.

According to aspects of this disclosure, UI component 225 may generate one or more graphical user interfaces (GUIs) for managing and presenting compliance metrics from compliance metric component 232. For example, UI component 225 may generate a GUI that includes a graphical representation of compliance metrics. In some examples, UI component 225 may group compliance metrics associated with a group of BWTDs and represent the group of compliance metrics, e.g., in a ranked list of compliance metrics.

While certain aspects of the example of FIG. 2 are described with respect to server device 114A, it should be understood that the techniques described herein may alternatively (or additionally) be performed by one or more other computing devices, such as one of BWTDs, as described in greater detail with respect to the example of FIG. 3 below.

Figure 3:
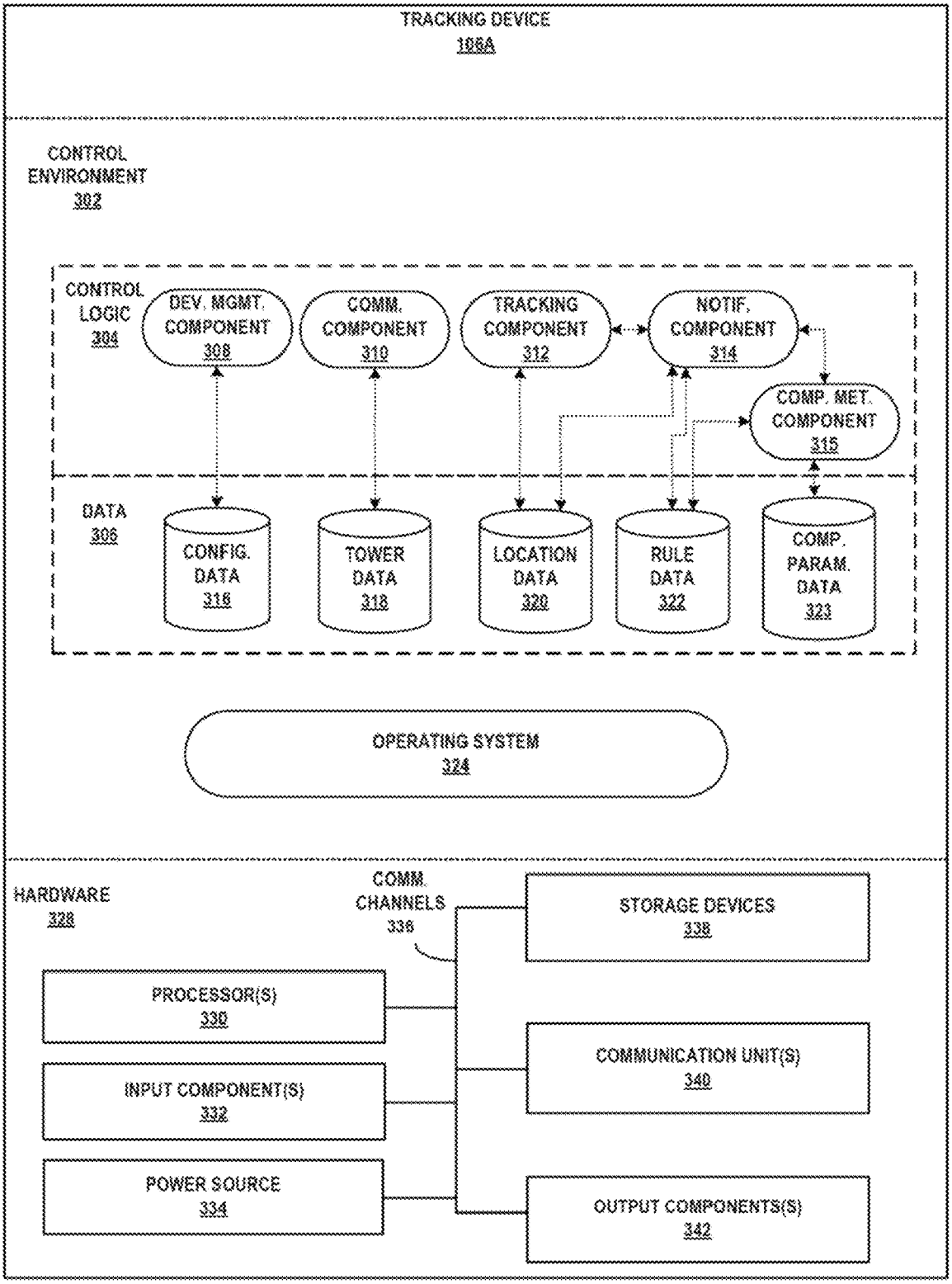
FIG. 3 is a block diagram illustrating an example tracking device, in accordance with one or more aspects of the present disclosure.

FIG. 3 is a block diagram illustrating an example tracking device, in accordance with one or more aspects of the present disclosure. FIG. 3 illustrates only one particular example of BWTD 106A, as shown in FIG. 1. Many other examples of BWTD 106A may be used in other instances and may include a subset of the components included in example BWTD 106A or may include additional components not shown BWTD 106A in FIG. 3. In some examples, BWTD 106A may run a set, subset, or superset of functionality included in control logic 304. In some examples, the external housing (not shown) of BWTD 106A may have one or more attachment components (not shown), such as straps, fasteners, magnetic materials, adhesive materials or any other mechanism or material for attaching or associating with tracking device 106A with an object to be tracked.

As shown in the example of FIG. 3, BWTD 106A may be logically divided into control environment 302 and hardware 328. Hardware 328 may include one or more hardware components that provide an operating environment for components executing in control environment 302. Control environment 302 may include operating system 324, which may or may not operate with higher privileges than other components executing in user space 202.

As shown in FIG. 3, hardware 328 includes one or more processors 330, input components 332, power source 334 storage devices 338, communication units 340, and output components 342. Processors 328, input components 332, power source 334, storage devices 338, communication units 340, and output components 342 may each be interconnected by one or more communication channels 336. Communication channels 336 may interconnect each of the components 330, 332, 334, 338, 340, and 342 for inter-component communications (physically, communicatively, and/or operatively). In some examples, communication channels 336 may include a hardware bus, a network connection, one or more inter-process communication data structures, or any other components for communicating data between hardware and/or software.

One or more processors 330 may implement functionality and/or execute instructions within BWTD 106A. For example, processors 330 on BWTD 106A may receive and execute instructions stored by storage devices 338 that provide the functionality of components included in control environment 302. These instructions executed by processors 330 may cause BWTD 106A to store and/or modify information, within storage devices 338 during program execution. Processors 330 may execute instructions of components in control environment 302 to perform one or more operations in accordance with techniques of this disclosure. That is, components included in user control environment 302 may be operable by processors 330 to perform various functions described herein.

One or more input components 332 of BWTD 106A may receive input. Examples of input are tactile, audio, kinetic, and optical input, to name only a few examples. Input components 332 of BWTD 106A, in one example, include a voice responsive system, video camera, buttons, control pad, microphone or any other type of device for detecting input from a human or machine. In some examples, input component 210 may be a presence-sensitive input component, which may include a presence-sensitive screen, touch-sensitive screen, etc.

One or more output components 342 of BWTD 106A may generate output. Examples of output are tactile, audio, and video output. Output components 342 of BWTD 106A, in some examples, include a presence-sensitive screen, sound card, video graphics adapter card, speaker, cathode ray tube (CRT) monitor, liquid crystal display (LCD), or any other type of device for generating output to a human or machine. Output components may include display components such as cathode ray tube (CRT) monitor, liquid crystal display (LCD), Light-Emitting Diode (LED) or any other type of device for generating tactile, audio, and/or visual output. Output components 106A may be integrated with BWTD 106A in some examples. In other examples, output components 342 may be physically external to and separate from BWTD 106A, but may be operably coupled to BWTD 106A via wired or wireless communication. An output component may be a built-in component of BWTD 106A located within and physically connected to the external packaging of BWTD 106A. In another example, output components 342 may be an external component of BWTD 106A located outside and physically separated from the packaging or housing of BWTD 106A. Output components 342 may provide haptic, vibratory or other tactile output.

One or more communication units 340 of BWTD 106A may communicate with external devices by transmitting and/or receiving data. For example, BWTD 106A may use communication units 340 to transmit and/or receive radio signals on a radio network such as a cellular or other wireless radio network. In some examples, communication units 340 may transmit and/or receive satellite signals on a satellite network such as a Global Positioning System (GPS) network. Examples of communication units 340 include a network interface card (e.g. such as an Ethernet card), an optical transceiver, a radio frequency transceiver, a GPS receiver, or any other type of device that can send and/or receive information. Other examples of communication units 340 may include Bluetooth®, GPS, 3G, 4G, and Wi-Fi® radios found in mobile devices as well as Universal Serial Bus (USB) controllers and the like.

One or more storage devices 338 within BWTD 106A may store information for processing during operation of BWTD 106A. In some examples, storage device 338 is a temporary memory, meaning that a primary purpose of storage device 338 is not long-term storage. Storage devices 338 on BWTD 106A may be configured for short-term storage of information as volatile memory and therefore not retain stored contents if deactivated. Examples of volatile memories include random access memories (RAM), dynamic random access memories (DRAM), static random access memories (SRAM), and other forms of volatile memories known in the art.

Storage devices 338, in some examples, also include one or more computer-readable storage media. Storage devices 338 may be configured to store larger amounts of information than volatile memory. Storage devices 338 may further be configured for long-term storage of information as non-volatile memory space and retain information after activate/off cycles. Examples of non-volatile memories include magnetic hard discs, optical discs, floppy discs, flash memories, or forms of electrically programmable memories (EPROM) or electrically erasable and programmable (EEPROM)

memories. Storage devices 338 may store program instructions and/or data associated with components included in control environment 302.

As shown in FIG. 3, BWTD 106A may include a power source 334. In some examples, power source 334 may be a battery. Power source 334 may provide power to one or more components of BWTD 106A. Examples of power source 334 may include, but are not necessarily limited to, batteries having zinc-carbon, lead-acid, nickel cadmium (NiCd), nickel metal hydride (NiMH), lithium ion (Li-ion), and/or lithium ion polymer (Li-ion polymer) chemistries. In some examples, power source 334 may have a limited capacity (e.g., 1000-3000 mAh).

As shown in FIG. 3, control logic 304 executes in control environment 302. Control logic 304 may include but is not limited to: device management component (DMC) 308, communication component 310, tracking component 312, and notification component 314. Data 306 may include one or more datastores. A datastore may store data in structure or unstructured form. Example datastores may be any one or more of a relational database management system, online analytical processing database, table, or any other suitable structure for storing data.

Configuration data 316 may include one or more of: a unique identifier of BWTD 106A, a unique identifier of the monitored person to which BWTD 106A is assigned, and/or any other properties or parameters that control or change the operation of tracking device 106A. Tower data 318 may include records, tuples or sets, wherein each record, tuple or set specifies one or more of: a unique identifier of a particular tower, a latitude and longitude of BWTD 106A when BWTD 106A detected or initiated a communication session with the particular tower, a signal strength for the tower when BWTD 106A detected or initiated a communication session with the particular tower, a directional heading of BWTD 106A when BWTD 106A detected or initiated a communication session with the particular tower, and/or a timestamp when BWTD 106A detected or initiated a communication session with the particular tower.

Data 306 may include location data 320. Location data 320 may include records, tuples or sets, wherein each record, tuple or set specifies one or more of: a unique identifier of BWTD 106A and/or monitored person wearing BWTD 106A, GPS coordinates (latitude, longitude), a timestamp when the GPS coordinates (latitude, longitude) were determined, GPS receive signal strength when the GPS coordinates (latitude, longitude) were determined, signal strength of a tower when the GPS coordinates (latitude, longitude) were determined, and/or a directional heading of BWTD 106A when the GPS coordinates (latitude, longitude) were determined.

Rule data 322 may include data that defines, one or more of: a restricted location/region, a permissible location/region, a time period for permitted travel with respect to a restricted/permissible location/region, permissible/restricted users who can or cannot be within a threshold distance of the monitored person, or any other property, rule, condition, to name only a few examples.

According to aspects of this disclosure, as described above with respect to the example of FIG. 3, compliance parameter data 323 may define compliance parameters for determining compliance metrics in accordance with the techniques of this disclosure. As described herein, compliance parameters may correspond to any characteristic of BWTDs or monitored persons wearing or carrying BWTDs that may be of interest to a monitoring party. For example, compliance parameters may be associated with permitted or prohibited geographical regions, time periods, proximities to locations or persons of interest, or the like. Compliance parameters may additionally or alternatively be associated with permitted or prohibited operating conditions of BWTDs 106 (e.g., a battery status of BWTDs 106, a wireless, cellular or satellite signal status of BWTDs 106, a condition of a restraint of BWTDs 106, or the like).

Compliance parameters of compliance parameter data 323 may be based on configuration data 316, tower data 318, location data 320, or other data, which may be referred to herein as characteristic data. Example compliance parameters include a zone compliance parameter, a location compliance parameter, a crime scene compliance parameter, an offender proximity compliance parameter, a temperature compliance parameter, a BWTD condition compliance parameter, a movement compliance parameter, or a wide variety of other compliance parameters.

Compliance parameter data 323 may also include weights for compliance parameters. For example, as described below, compliance metric component 315 may apply one or more weights to respective compliance parameters of a set of compliance parameters to form a set of weighted compliance parameters. Weights of compliance parameter data 323 may be determined based on, for example, a perceived importance of compliance parameters, conditions of release or parole, a history of events for a monitored person, or the like. Weights for compliance parameters may take a variety of forms, such as scalar weights, discrete weights, or the like.

In operation, DMC 308 may initially be configured with configuration data 316. For instance, DMC 308 may be programmed, from an external computing device, with a unique identifier for BWTD 106A and/or a unique identifier of the monitored person associated with or assigned to BWTD 106A. Once BWTD 106A has been configured with configuration data 316, the monitored person may move about one or more geographic regions.

Communication component 310 may initiate, manage, and terminate communication sessions with towers that provide network infrastructure. In particular, as BWTD 106A moves to different geographic regions, communication component 310 may initiate communication sessions with different towers in the different regions. In this way, communication component 310 maintains communication between BWTD 106A and monitoring center 112.

Tracking component 312 may determine the location of BWTD 106A based on signals received from GPS (or other GNSS) satellites, such as satellites 108 in FIG. 1. For instance, tracking component 312 may determine the latitude and longitude of BWTD 106A at a particular point time. Tracking component 312 may determine the latitude and longitude on a periodic basis according to an interval that may be included in configuration data 312. The time interval may be programmed by a user, dynamically changed (e.g., based on one or more detected or determined events) or hard-coded. At a point in time (e.g., when a time interval has elapsed), upon determining the latitude and longitude, tracking component 312 may generate and store a record, tuple or set that specifies one or more of: a unique identifier of BWTD 106A and/or monitored person wearing BWTD 106A, GPS coordinates (latitude, longitude), a timestamp when the GPS coordinates (latitude, longitude) were determined, GPS receive signal strength when the GPS coordinates (latitude, longitude) were determined, signal strength of a tower when the GPS coordinates (latitude, longitude) were determined, and/or a directional heading of BWTD 106A when the GPS coordinates (latitude, longitude) were determined. Tracking component 312 may send location data 320 to monitoring center 112 in FIG. 1 in real-time, periodically, or asynchronously, as described in some examples of FIG. 1.

Notification component 314 may receive notifications from external computing devices such as monitoring center 112 and/or user devices 116, as shown in FIG. 1. Notification component 314 may generate and send notifications to one or more external computing devices such as monitoring center 112 and/or user devices 116.

In some examples, notifications generated by notification component 314 may be based on input from compliance metric component 315. For example, compliance metric component 315 may be configured to determine one or more compliance metrics based on a set of compliance parameters, e.g., from compliance parameter data 323. For example, compliance metric component 315 may determine compliance metrics based on any aggregation of compliance parameters from compliance parameter data. In some examples, compliance metric component 315 may be configured to apply weights to compliance parameters when determining a compliance metric.

In some examples, compliance metric component 315 may determine compliance metrics based on a plurality of other compliance metrics. For example, compliance metric component 315 may determine a plurality of compliance metrics over a period of time and may aggregate the compliance metrics to generate a representative compliance metric for the period of time. In some examples, compliance metric component 315 may apply an averaging function or another mathematical function to the plurality of compliance metrics to determine the representative compliance metric.

According to aspects of this disclosure, notifications generated by notification component 314 may be based on a compliance metric from compliance metric component 315 being greater than or less than a threshold value. For example, notification component 314 may generate visual, audio, haptic or any other type of discernable feedback based on a compliance metric from compliance metric component 315 being greater than or less than a threshold value.

Figure 4:
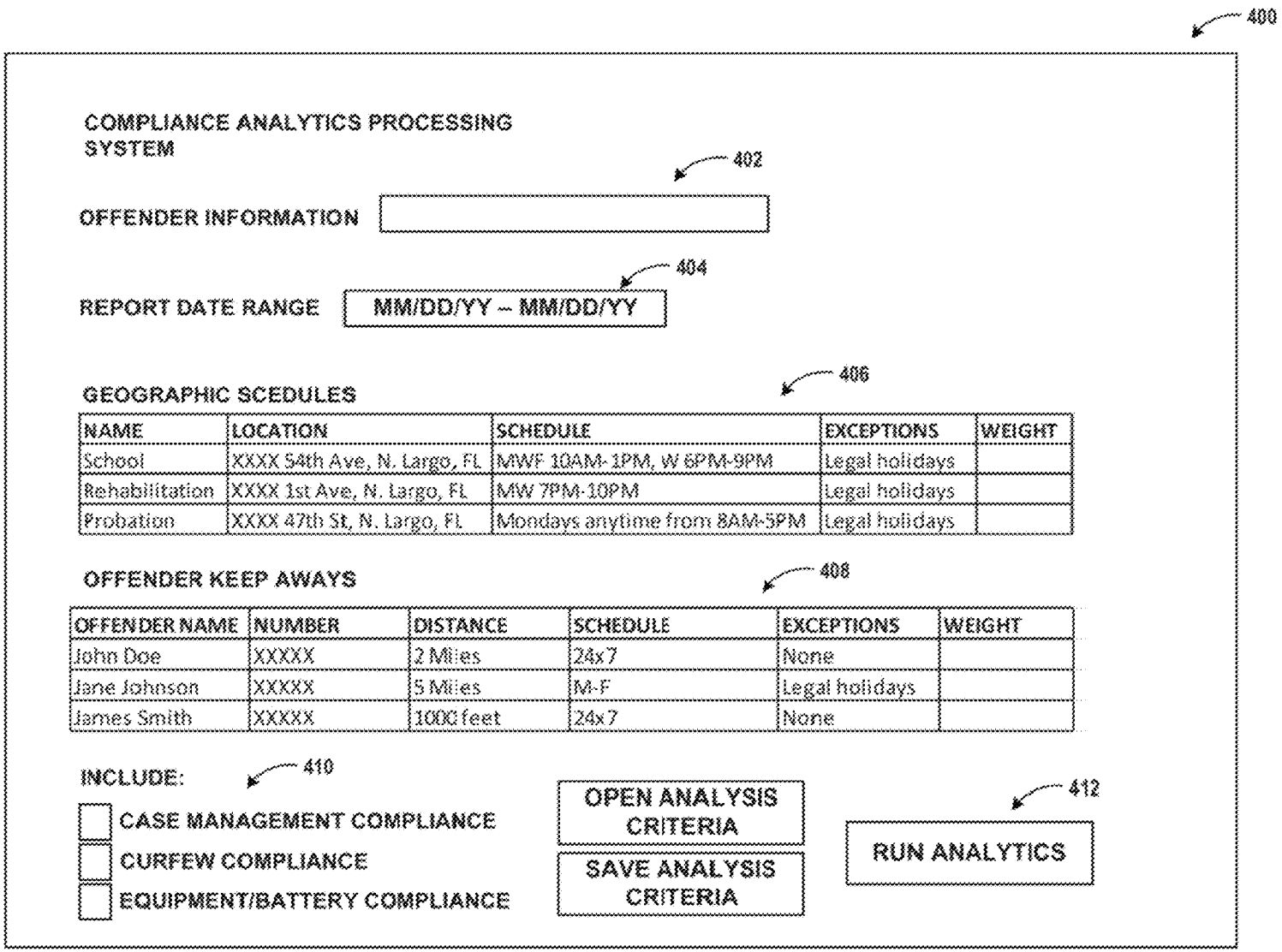
FIG. 4 is an illustration of a graphical user interface for generating a compliance metric, in accordance with techniques of this disclosure.

FIG. 4 is an illustration of a graphical user interface for generating a compliance metric, in accordance with techniques of this disclosure. In some examples, the graphical content shown in the example of FIG. 4 may be hosted by monitoring center 112 for presentation by user devices 116 (FIG. 1). In other examples, user devices 116 may include a native application for generating the graphical content.

In any case, FIG. 4 generally illustrates one example of a GUI for managing compliance metrics for one or more monitored persons 106. For example, one of monitoring users 118 (monitoring user 118A for purposes of example) may enter a name of a monitored person in offender information field 402. In some examples, filed 402 may be a drop-down list of monitored persons 104 for which monitoring user 118A is responsible.

Monitoring user 118A may enter a date range in report date range filed 404. In some examples, the date range may determine the characteristic data that contributes to a compliance metric. That is, the generated compliance metric may be determined based on instances of characteristic data that occur in the date range.

Monitoring user 118A may use GUI 400 to specify one or more compliance parameters. The illustrated example includes a number of location compliance parameters 406 and zone compliance parameters 408. With respect to location compliance parameters 406, monitoring user 118A may enter a location of interest in the name field, a location address or other identifier in the location field, times associated with the location in the schedule field, exceptions that apply to the schedule in the exceptions field, and a compliance parameter weight in the weight field.

In an example for purposes of illustration, monitored person 104A may be permitted (or required) to attend school courses on Mondays, Wednesdays, and Fridays from 10 AM-1 PM and on Wednesdays from 6 PM-9 PM, except for legal holidays. In this example, BWTD 106A may be configured to generate an alert or notification in instances in which BWTD 106A is not located at the school location at the specified times.

According to aspects of this disclosure, continuing with the example above, monitoring center 112 may determine a compliance metric using the school location compliance parameter (as well as the other illustrated compliance parameters) as an input. The value of the school compliance parameter may vary based on whether monitored person 104A attends school courses at the specified times. In addition, the school compliance parameter may be weighted, e.g., relative to the other location compliance parameters 406 (and/or zone compliance parameters 408 or other compliance parameters). Hence, the determined compliance metric may represent a level of compliance that is based on contributing compliance parameters.

With respect to zone compliance parameters 408, monitoring user 118A may enter a name or other identifying characteristic in the offender name and number fields, a distance from which monitored person 104A (and, hence, BWTD 106A) is required to maintain or keep away from the offender identified in the name field, the times at which monitored person 104A is required to keep away in the schedule field, exceptions that apply to the schedule in the exceptions field, and a compliance parameter weight in the weight field.

In an example for purposes of illustration, monitored person 104A may be permitted (or required) to stay a distance of two miles away from John Doe at all times. In this example, BWTD 106A may be configured to generate an alert or notification in instances in which BWTD 106A is located nearer to John Doe than two miles. According to aspects of this disclosure, monitoring center 112 may determine a compliance metric using the John Doe zone compliance parameter as an input. The value of the zone compliance parameter may vary based on whether monitored person 104A maintains the appropriate distance from John Doe at the specified times. In addition, the zone compliance parameter may be weighted, e.g., relative to the other compliance parameters 406 and 408. Hence, the determined compliance metric may represent a level of compliance that is based on contributing compliance parameters.

The example of FIG. 4 also includes a number of additional compliance parameters 410. In the illustrated example, additional compliance parameters 410 include a case management compliance parameter, a curfew compliance parameter, and an equipment compliance parameter. These compliance parameters may indicate, as examples, whether monitored person 104A provides updates or check-ins for case management purposes, whether monitored person 104A satisfies curfew requirements, and whether monitored person 104A maintains BWTD 106A in proper working condition (e.g., restraints intact, battery charged and communication/location signals established). Additional compliance parameters 410 are provided for purposes of illustration only, and it should be understood that a variety of other compliance parameters may be included.

Run analytics field 412 is a user selectable element that initiates determination of a compliance metric based on the compliance parameters included in GUI 400. As described herein, monitoring center 112 may mine a data warehouse containing minute-by-minute (or another interval) location and status data for monitored person 104A and determine a compliance metric based on such data. In addition, in some examples, monitoring center 112 may implement algorithms that correlate the location and status of other monitored persons 104. This information, along with compliance parameters may be used to determine if monitored person 104A is exceptionally complainant (e.g., attends school on time, attends rehabilitation, do not associate with other monitored persons 104, accurately meet monitoring and/or probation conditions, maintain monitoring equipment correctly, and the like).

Figure 5:
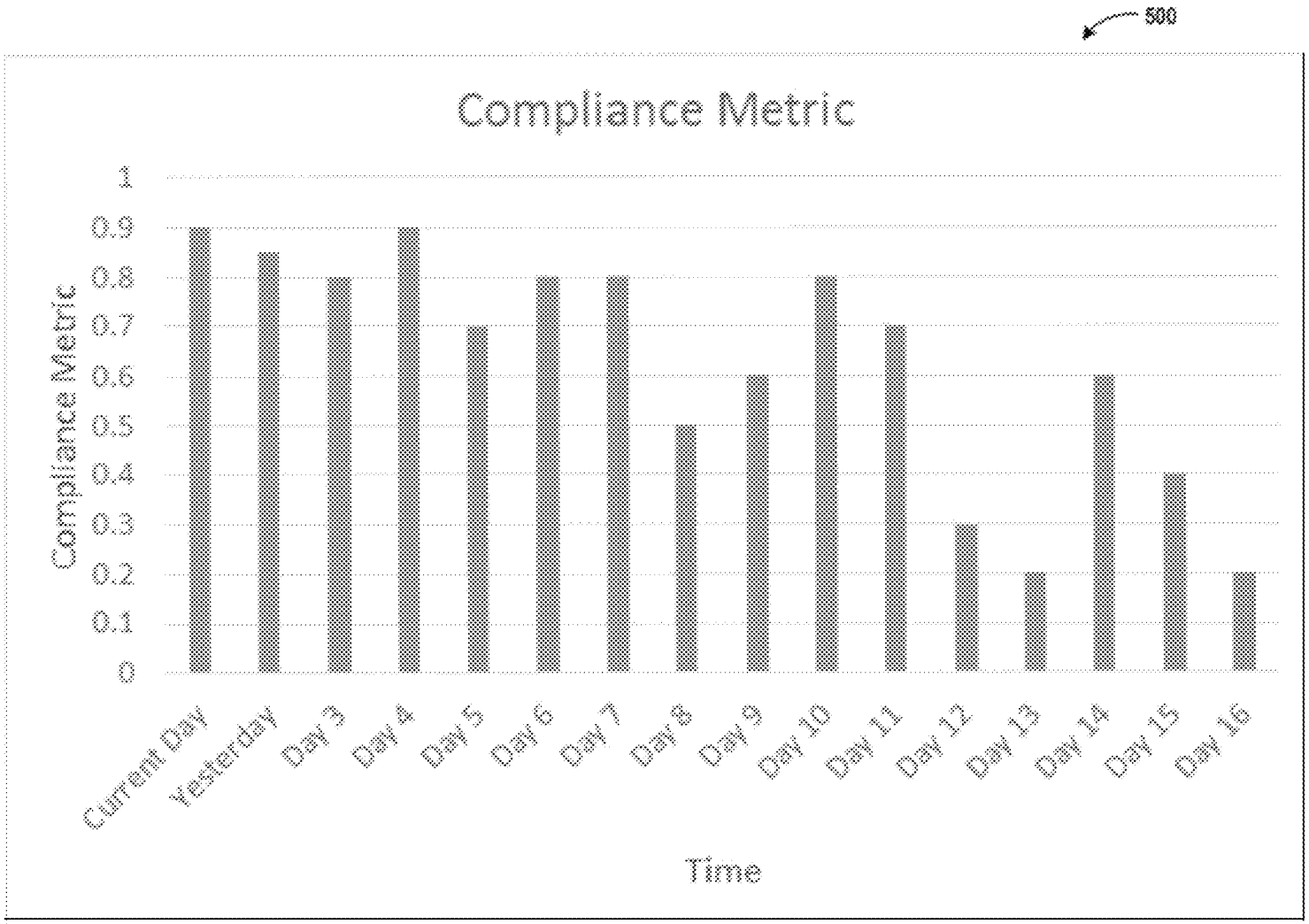
FIG. 5 is an illustration of bar chart that represents compliance metrics over a time period, in accordance with techniques of this disclosure.

FIG. 5 is an illustration of bar chart 500 that represents compliance metrics over a time period, in accordance with techniques of this disclosure. According to aspects of this disclosure, the content shown in the example of FIG. 5 may be generated by UI component 225 (FIG. 2). For example, content shown in the example of FIG. 5 may be generated by monitoring center 112 for presentation by user devices 116 (FIG. 1).

The example illustrated in FIG. 5 generally illustrates compliance metrics for a particular monitored person over a period of time that includes the current day and the previous 15 days. The compliance metrics are shown as having one value per day between zero and one. In other examples, compliance metrics may be determined more or less frequently and/or may be measured on a different scale.

In some examples, monitoring users 118 (FIG. 1) determine, based on bar chart 500, a level of compliance for a particular monitored person over a period of time, e.g., as measured by the compliance metrics. In addition, monitoring users 118 may determine whether the level of compliance is improving (or declining) for a particular monitored person over time.

FIG. 6 is an illustration of a chart 600 that contains compliance metrics ("compliance scores") for a plurality of monitored persons 106 ("parolee"). According to aspects of this disclosure, the content shown in the example of FIG. 6 may be generated by UI component 225 (FIG. 2). For example, content shown in the example of FIG. 6 may be generated by monitoring center 112 for presentation by user devices 116 (FIG. 1).

In some instances, monitoring center 112 may determine a group of compliance metrics 122 associated with a group of BWTDs 106 (and associated monitored persons 104, referred to as parolees in the example of FIG. 6). The group may be based on BWTDs 106 assigned to a particular monitoring user 118 responsible for monitoring the group of BWTDs 106 (e.g., a parole officer responsible for monitoring a plurality of monitored persons 104 and associated BWTDs 106). Monitoring user 118 may determine, based on chart 600, which monitored persons may require the most attention for successful rehabilitation.

In some instances, monitoring center 112 may determine, separately from the group of compliance metrics 122, an administrator score for monitoring user 118 based on the group of compliance metrics 122. That is, for example, monitoring center 112 may determine an administrator score that indicates a level of compliance of monitored persons 106 for which the administrator is responsible. In this example, the administrator score may be based on an aggregate of compliance metrics from all of the monitored persons being monitored by monitoring user 118.

Figure 7:
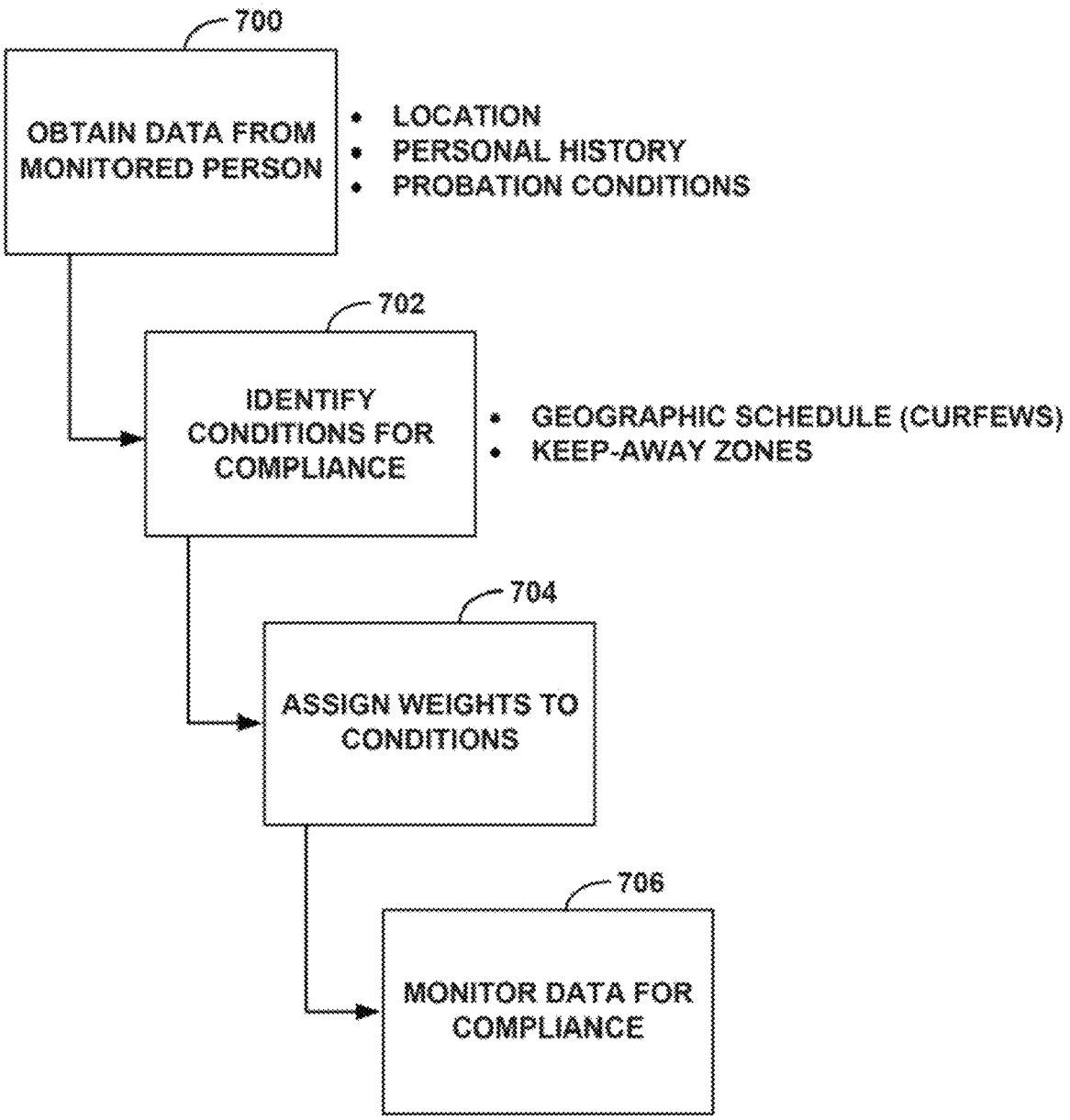
FIG. 7 is a flow diagram illustrating an example process for determining a compliance metric, in accordance with techniques of this disclosure.

FIG. 7 is a flow diagram illustrating an example process for determining a compliance metric, in accordance with techniques of this disclosure. While described with respect to the system shown in FIG. 1, it should be understood that the process described with respect to FIG. 7 may be carried out by a variety of other computing systems.

In the illustrated example, monitoring center 112 may obtain data from one of monitored persons 104 (700). As described herein, the data may include data associated with the monitored person, the associated BWTD, and/or other relevant information, as location information, personal history information, probation conditions, or the like. Monitoring center 112 may also identify conditions for compliance (702). The conditions for compliance may be compliance parameters, e.g., as provided by monitoring users 118 via GUI 400 (FIG. 4). Conditions for compliance may include, as examples, geographic schedules (e.g., referred to herein as location compliance parameters), keep-away zones (e.g., referred to herein as zone compliance parameters), and/or other conditions/parameters.

Monitoring center 112 may assign weights to the various conditions (704). In some examples, monitoring center 112 may apply default weights to conditions in order to maintain consistency among monitoring users 118. In other examples, weights may be configurable, e.g., based on case history and/or monitoring users 118. Monitoring center 112 may then monitor the obtained data for compliance (706). For example, monitoring center 112 may generate one or more compliance metrics that indicate a level of compliance. In some instances, monitoring center 112 may be configured to automatically determine compliance metrics on a periodic basis.

Figure 8:
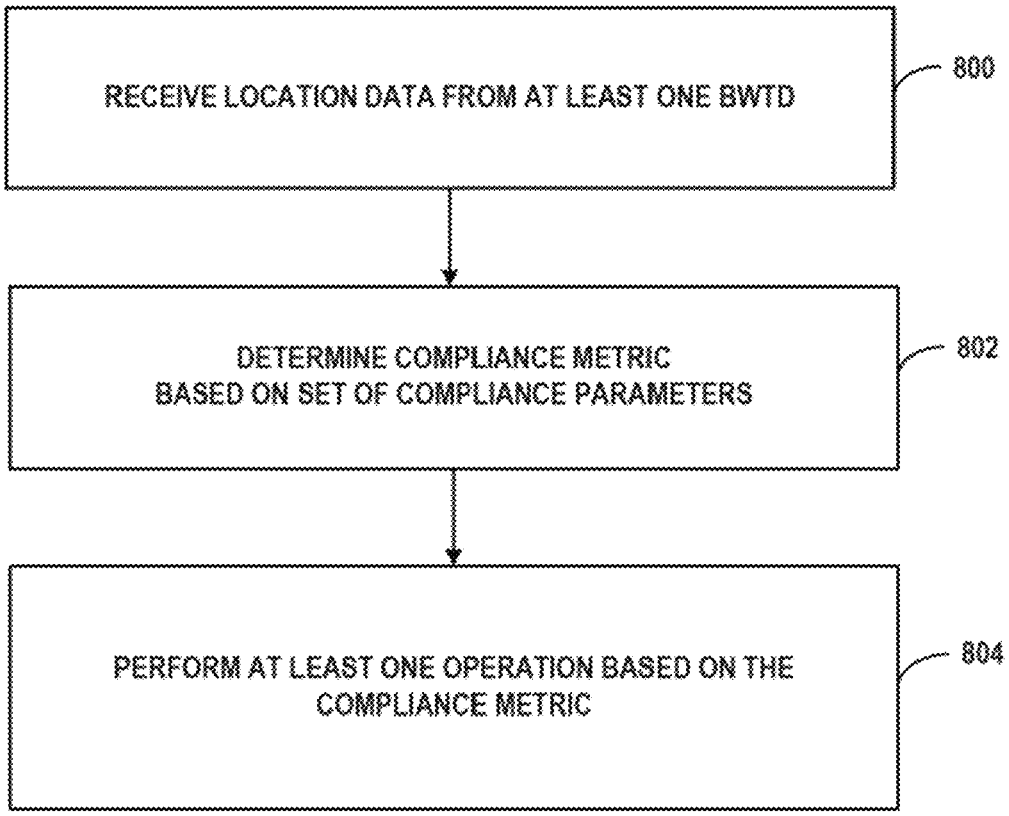
FIG. 8 is a flow diagram illustrating example operations of a computing device configured to determine a compliance metric, in accordance with techniques of this disclosure.

FIG. 8 is a flow diagram illustrating example operations of a computing device configured to determine a compliance metric, in accordance with techniques of this disclosure. While described with respect to the system shown in FIG. 1, it should be understood that the process described with respect to FIG. 8 may be carried out by a variety of other computing systems.

In the illustrated example, monitoring center 112 may receive location data from at least one of BWTDs 106 (800). The location data may indicate a location of BWTDs (e.g., GNSS location) and timestamps indicating the time of capture. In some examples, monitoring center 112 may also receive a variety of other data, such as characteristic data that indicates characteristics of monitored persons 104 and/or BWTDs 106.

Monitoring center 112 may determine a compliance metric based on a set of compliance parameters (802). As described herein, compliance parameters may correspond to any characteristic of BWTDs or monitored persons wearing or carrying BWTDs that may be of interest to a monitoring party. For example, compliance parameters may be associated with permitted or prohibited geographical regions, time periods, proximities to locations or persons of interest, or the like. Compliance parameters may additionally or alternatively be associated with permitted or prohibited operating conditions of BWTDs 106 (e.g., a battery status of BWTDs 106, a wireless, cellular or satellite signal status of BWTDs 106, a condition of a restraint of BWTDs 106, or the like).

Monitoring center 112 may determine the compliance metric based on any aggregation of compliance parameters. In some examples, monitoring center 112 may be configured to apply weights to compliance parameters when determining the compliance metric. The weights may that indicate a contribution influence of a compliance parameter, e.g., relative to other compliance parameters.

Monitoring center 112 may perform at least one operation based on the compliance metric (804). In some examples, monitoring center 112 may output data that represents the compliance metric for display at user devices 116. Additionally or alternatively, monitoring center 112 may generate alerts, which may be visual, audio, haptic or any other type of discernable feedback, for output by BWTDs 106. In some examples, monitoring center 112 may generate an electronic message that includes suggestions for improving a compliance metric.

In one or more examples, the functions described may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media, which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor", as used may refer to any of the foregoing structure or any other structure suitable for implementation of the techniques described. In addition, in some aspects, the functionality described may be provided within dedicated hardware and/or software modules. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

It is to be recognized that depending on the example, certain acts or events of any of the methods described herein can be performed in a different sequence, may be added, merged, or left out altogether (e.g., not all described acts or events are necessary for the practice of the method). Moreover, in certain examples, acts or events may be performed concurrently, e.g., through multi-threaded processing, interrupt processing, or multiple processors, rather than sequentially.

In some examples, a computer-readable storage medium includes a non-transitory medium. The term "non-transitory" indicates, in some examples, that the storage medium is not embodied in a carrier wave or a propagated signal. In certain examples, a non-transitory storage medium stores data that can, over time, change (e.g., in RAM or cache).

Various examples have been described. These and other examples are within the scope of the following claims.

What is claimed is:

1. A system comprising:

at least one body-worn tracking device (BWTD) configured to transmit location data that indicates a location of the at least one BWTD; and a computing system configured to communicate with the at least one BWTD, and wherein the computing system is further configured to:

receive the location data from the at least one BWTD;

determine, for a time period comprising a plurality of instances of the location data, a compliance metric based on a set of compliance parameters, the compliance metric indicating a level of compliance for at least one offender for the time period;

perform at least one operation based on the compliance metric;

determine an offender proximity compliance value based on the location data, wherein the offender proximity compliance value indicates whether the at least one BWTD is in proximity to one or more other BWTDs; and wherein a compliance parameter of the set of compliance parameters comprises the offender proximity compliance value, wherein the at least one BWTD comprises a plurality of BWTDs, each BWTD of the plurality having a respective corresponding compliance metric, and wherein to perform the at least one operation, the computing system is configured to generate GUI data for a GUI that comprises a ranking of the respective corresponding compliance metrics.

2. The system of claim 1, wherein the at least one BWTD is configured to transmit temperature data that indicates a temperature of an environment in which the at least one BWTD is disposed; and wherein a compliance parameter of the set of compliance parameters comprises a temperature value based on the temperature data.

3. The system of claim 1, wherein the at least one BWTD is configured to transmit BWTD condition data that indicates at least one of a status of a battery of the at least one BWTD, whether a restraint of the BWTD is intact, or whether multiple components of the at least one BWTD are in proximity to one another; and wherein a compliance parameter of the set of compliance parameters comprises at least one condition value based on the condition data.

4. The system of claim 1, wherein the at least one BWTD is configured to transmit movement data that indicates movement of the BWTD; and wherein a compliance parameter of the set of compliance parameters comprises a movement value based on the movement data.

5. The system of claim 1, wherein to perform the at least one operation based on the compliance metric, the computing system is configured to generate graphical user interface (GUI) data for a GUI that comprises an indication of the compliance metric.

6. The system of claim 1, wherein the computing system is further configured to:

determine groups of BWTDs of the plurality of BWTDs by administrator assigned to the BWTDs; and generate administrator scores based on compliance metrics of the groups of BWTDs.

7. The system of claim 1, wherein to perform the at least one operation, the computing system is configured to adjust a sampling rate of the at least one BWTD.

8. A system comprising:

at least one body-worn tracking device (BWTD) configured to transmit location data that indicates a location of the at least one BWTD; and a computing system configured to communicate with the at least one BWTD, and wherein the computing system is further configured to:

receive the location data from the at least one BWTD;

determine, for a time period comprising a plurality of instances of the location data, a compliance metric based on a set of compliance parameters, the compliance metric indicating a level of compliance for at least one offender for the time period;

perform at least one operation based on the compliance metric;

determine an offender proximity compliance value based on the location data, wherein the offender proximity compliance value indicates whether the at least one BWTD is in proximity to one or more other BWTDs;

wherein a compliance parameter of the set of compliance parameters comprises the offender proximity compliance value, generate one or more electronic messages comprising suggestions for improving the compliance metric; and transmit the one or more electronic messages to a computing device associated with any offender assigned to the BWTD.

9. The system of claim 8, wherein the at least one BWTD is configured to transmit temperature data that indicates a temperature of an environment in which the at least one BWTD is disposed; and wherein a compliance parameter of the set of compliance parameters comprises a temperature value based on the temperature data.

10. The system of claim 8, wherein the at least one BWTD is configured to transmit BWTD condition data that indicates at least one of a status of a battery of the at least one BWTD, whether a restraint of the BWTD is intact, or whether multiple components of the at least one BWTD are in proximity to one another; and wherein a compliance parameter of the set of compliance parameters comprises at least one condition value based on the condition data.

11. The system of claim 8, wherein the at least one BWTD is configured to transmit movement data that indicates movement of the BWTD; and wherein a compliance parameter of the set of compliance parameters comprises a movement value based on the movement data.

12. The system of claim 8, wherein to perform the at least one operation based on the compliance metric, the computing system is configured to generate graphical user interface (GUI) data for a GUI that comprises an indication of the compliance metric.

13. The system of claim 8, wherein the computing system is further configured to:

determine groups of BWTDs of the plurality of BWTDs by administrator assigned to the BWTDs; and generate administrator scores based on compliance metrics of the groups of BWTDs.

14. The system of claim 8, wherein to perform the at least one operation, the computing system is configured to adjust a sampling rate of the at least one BWTD.

* * * * *